US006677092B2

(12) United States Patent
Arai

(10) Patent No.: US 6,677,092 B2
(45) Date of Patent: Jan. 13, 2004

(54) MAGNETIC TONER FOR MICR PRINTERS, DEVELOPER FOR MICR PRINTERS AND MANUFACTURING METHOD THEREOF

(75) Inventor: Takaaki Arai, Mie (JP)

(73) Assignee: Kyocera Corporation, Kyoto (JP)

( * ) Notice: Subject to any disclaimer, the term of this patent is extended or adjusted under 35 U.S.C. 154(b) by 159 days.

(21) Appl. No.: 09/840,801

(22) Filed: Apr. 23, 2001

(65) Prior Publication Data

US 2001/0053491 A1 Dec. 20, 2001

(30) Foreign Application Priority Data

Apr. 27, 2000 (JP) ..... 2000-127142
Aug. 2, 2000 (JP) ..... 2000-234641

(51) Int. Cl.[7] ..... G03G 9/083

(52) U.S. Cl. ..... 430/106.1; 430/108.6; 430/108.7; 430/137.11; 430/137.21

(58) Field of Search ..... 430/106.1, 108.6, 430/137.11, 108.7, 137.21

(56) References Cited

U.S. PATENT DOCUMENTS 4,933,251 A * 6/1990 Ichimura et al. ..... 430/108.6
5,034,298 A 7/1991 Berkes et al.
5,639,584 A * 6/1997 Anno et al. ..... 430/108.6
5,714,292 A * 2/1998 Anno et al. ..... 430/108.7
5,733,701 A * 3/1998 Anno et al. ..... 430/108.8
5,976,748 A 11/1999 Arai et al.
5,994,019 A * 11/1999 Okado et al. ..... 430/108.6
6,214,512 B1 * 4/2001 Takano et al. ..... 430/108.6

FOREIGN PATENT DOCUMENTS

| | | |
|---|---|---|
| JP | 2-134648 | 5/1990 |
| JP | 4-358164 | 12/1992 |
| JP | 4-358165 | 12/1992 |
| JP | 5-080582 | 4/1993 |
| JP | 7-077829 | 3/1995 |
| JP | 11-327204 | 11/1999 |
| JP | 11-327205 | 11/1999 |

OTHER PUBLICATIONS

Klein, Cornelius et al. Manual of Mineralogy. New York: John Wiley & Sons. pp. 304 & 305. (1985).*

Diamond, Arthur S. (editor) Handbook of Imaging Materials. New York: Marcel–Dekker, Inc. pp. 168–170. (1991).*

* cited by examiner

*Primary Examiner*—Christopher Rodee
(74) *Attorney, Agent, or Firm*—Hogan & Hartson

(57) ABSTRACT

A magnetic toner for MICR printers is provided with a binder resin, magnetic powder, and metal oxide particles which are in the outer surface of each toner base particle made from the binder resin and the magnetic powder, the metal oxide particles having a volume resistivity of $1\times10^5$ to $1\times10^{11}$ Ω·cm. A developer containing this MICR toner makes it possible to provide superior image density and reading precision, even after 150,000 to 300,000 sheets of A-4 paper have been continuously printed.

11 Claims, 6 Drawing Sheets

MAGNETIC TONER FOR MICR PRINTERS, DEVELOPER FOR MICR PRINTERS AND MANUFACTURING METHOD THEREOF

BACKGROUND OF THE INVENTION

1. Field of the Invention

The present invention relates to a magnetic toner for MICR printers, a developer for MICR printers and a manufacturing method thereof, and, more specifically, concerns a magnetic toner for MICR printers and a developer for MICR printers which, even after, for example, 150,000 to 300,000 sheets of A4-paper have been continuously printed, still provide superior image density and reading precision, and a manufacturing method thereof.

2. Description of the Background Art

In recent years, with respect to checks, securities, bills, tickets, etc., in order to prevent counterfeit and illegal copies thereof, identification marks referred to as "fonts" have come to be printed. This counterfeit prevention system using such identification marks is generally referred to as MICR system (Magnetic Ink Character Recognition System), and toner used for printing these fonts by the electrophotographing system is referred to as magnetic toner for MICR printers (in some cases, referred to simply as MICR toner or magnetic toner). These are, for example, disclosed in Japanese Laid-Open Patent Application No. 134648/1990, Japanese Laid-Open Patent Application No. 80582/1993 and U.S. Pat. No. 5,034,298.

However, the conventional MICR toner tends to have problems of low image density and susceptibility to reading errors. Moreover, since the MICR toner contains special magnetic powder, it tends to have high values in the specific gravity and residual magnetization and to form aggregation, resulting in degradation in the fluidity and transporting property.

In order to solve these problems, Japanese Laid-Open Patent Applications No. 358164/1992, No. 358165/1992 and No. 77829/1995 have disclosed MICR toners which use two types of magnetic powders so that the residual magnetization is set in the range of 4.0 to 7.0 emu/g.

However, these MICR toners are still susceptible to reading errors, need to increase the image density, and are inferior in durability, and another problem is that magnetic power contained therein is inferior in the dispersing property.

Therefore, the inventors of the present invention have filed Japanese Patent Application No. 137153/1998 which has proposed an MICR toner that contains first magnetic powder having a residual magnetization of 24 to 40 emu/g and second magnetic powder having a residual magnetization of 1 to 24 emu/g (where 24 emu/g is not included) so that the residual magnetization of the entire toner is set to 7 to 20 emu/g (where 7 emu/g is not included), and that consequently achieves superior image density and reading precision.

Moreover, the application has also proposed that in order to improve the fluidity, etc., dried silica fine powder which has been treated by a silane coupling agent and silicone oil should be externally added thereto.

However, although the MICR toner, which has been proposed in Japanese Patent Application No. 137153/1998, is superior in the initial image density and reading precision, the reading precision gradually drops as sheets of A-4 paper are continuously printed, and the reading precision tends to become not more than 80% when approximately 50,000 prints have been made. Consequently, with respect to MICR toner that satisfies the long-term printing property required for the application of an amorphous silicon photosensitive member, that is, for example, the endurance of continuous printing of 150,000 to 300,000 sheets of A-4 paper, this toner is insufficient in its durability.

Moreover, in the case where the dried silica fine power is externally added to the MICR toner, since the average particle size of the dried silica fine powder is small, it fails to provide sufficient abrasive effects, and the external application of the dried silica fine powder causes an increase in the quantity of charge, resulting in failure to provide sufficient conductivity controlling effects. Therefore, in the case where the dried silica fine powder is externally applied, much adhesive powder such as toner fine powder, paper powder and a mixture of these tends to remain on the amorphous silicon photosensitive member, after continuous printing processes of approximately 50,000 sheets of A-4 paper.

SUMMARY OF THE INVENTION

The objective of the present invention is to provide an MICR toner, a developer for MICR printers and a manufacturing method thereof, which allow the MICR toner itself to exert abrasive effects so as to reduce the amount of adhesive powder such as toner fine powder, paper powder and a mixture of these remaining on an amorphous silicon photosensitive member, and also allow the MICR toner to exert conductivity regulating effects so that, even after, for example, 150,000 to 300,000 sheets of A-4 paper have been continuous printed by using an electrophotographing apparatus having an amorphous silicon photosensitive member, etc. with a SiC surface, it provides superior image density and reading precision.

The inventors, etc. of the present invention have studied hard and found that, when metal oxide particles having a specific volume resistivity are fixed onto the outer surface of MICR toner (toner base particles), the resulting metal oxide particles, when applied to an amorphous silicon photosensitive member having a silicon carbide (SiC) surface, etc., exert particular abrasive functions, and superior conductivity regulating functions so that the MICR toner itself is allowed to scrape MICR toner remaining on the photosensitive member to improve the durability and also to effectively prevent a so-called image blurring phenomenon.

A first aspect of the present invention provides a magnetic toner for MICR printers which comprises a binder resin, magnetic powder and metal oxide particles which are in the outer surface of each toner base particle made from the binder resin and the magnetic powder, the metal oxide particles having a volume resistivity of $1\times10^5$ to $1\times10^{11}$ $\Omega\cdot$cm.

In other words, the above-mentioned arrangement allows the MICR toner itself to exert abrasive effects, and makes it possible to strictly control the conductive stability of the MICR toner; thus, it becomes possible to greatly improve the image density and durability with respect to reading precision.

Moreover, upon forming the MICR toner of the present invention, it is preferable to provide the following arrangements:

(1) A part of the metal oxide particles are exposed.

(2) The metal oxide particles have an average particle size of 50 nm to 1 $\mu$m.

(3) The hardness of the metal oxide particles is 5 to 7.5 in Moh's hardness.

(4) The addition amount of the metal oxide particles is 0.1 to 2% by weight of an entire amount.

(5) The kinds of the metal oxide particles are aluminum oxide (alumina), titanium oxide (titania), or combination thereof.

With the above-mentioned arrangements, it is possible to allow the MICR toner itself to exert further superior abrasive effects, and also to provide a better conductivity controlling property.

Moreover, upon forming the MICR toner of the present invention, the magnetic powder is preferably prepared as a mixture of first magnetic powder having a residual magnetization of 24 to 40 emu/g and second magnetic powder having a residual magnetization of 1 to 24 exclusive emu/g (i.e., 1 inclusive to 24 exclusive emu/g).

With this arrangement, it is possible to greatly improve the dispersing property of the magnetic powder in the MICR toner, and consequently to improve the image density and the reading precision.

Moreover, a second aspect of the present invention provides a manufacturing method of a magnetic toner for MICR printers comprising the steps of forming a toner base particle by mixing a binder resin and magnetic powder and adding metal oxide particles having a volume resistivity of $1\times10^5$ to $1\times10^{11}$ Ω·cm to the outer surface of each toner base particle.

Furthermore, upon carrying out the manufacturing method of the MICR toner, the metal oxide particles are preferably fixed to the outer surface by using a fluidizing mixer, a mechanical fixing device, a high-speed air-flow impact fixing device or a thermal fixing device.

The application of each of these fixing devices makes it possible to easily fix the metal oxide particles onto the outer surface with a part of each particle being exposed.

Moreover, a third aspect of the present invention provides a developer used for MICR printers, which comprises the MICR toner of the first aspect and a carrier.

In other words, since predetermined metal oxide particles are contained, it is possible to allow the MICR toner itself to exert abrasive effects, and also to strictly control the conductivity of the MICR toner; thus, it becomes possible to greatly improve the image density and the durability with respect to the reading precision.

Moreover, the carrier is mixed into the MICR toner so as to form a two-component-type developer for MICR printers; thus, as compared with one-component-type developer, it is possible to further improve the transporting property and the image density, etc., of the MICR toner.

Furthermore, since the transporting property of the MICR toner is improved by the functions of the carrier, the selectable range and permissible range of the kinds, addition amount and other factors of magnetic powder that is usable for MICR toner are widened.

Moreover, in the developer for MICR printers of the present invention, the following arrangements are preferably adopted so as to allow the MICR toner itself to exert superior abrasive effects and also to allow the MICR toner to have a better conductivity-controlling property.

(1) A part of the metal oxide particles are exposed.

(2) The metal oxide particles have an average particle size of 500 nm to 1 μm.

(3) The hardness of the metal oxide particles is 5 to 7.5 in Moh's hardness.

(4) The addition amount of the metal oxide particles is 0.1 to 2% by weight of an entire amount.

(5) The kinds of the metal oxide particles are aluminum oxide (alumina), titanium oxide (titania), or combination thereof.

Moreover, upon forming the developer for MICR printers of the present invention, the magnetic powder in the MICR toner is preferably prepared as a mixture of first magnetic powder having a residual magnetization of 24 to 40 emu/g and second magnetic powder having a residual magnetization of 1 to 24 exclusive emu/g.

With this arrangement, it is possible to greatly improve the dispersing property of the magnetic powder in the MICR toner, and consequently to improve the image density and the reading precision as well as greatly improving the transporting property of the MICR toner.

Moreover, upon forming the developer for MICR printers of the present invention, it is preferable to externally add magnetic powder carrier and resin coat carrier, or either one of these, to the MICR toner.

With this arrangement, it is possible to greatly improve the transporting property of the MICR toner, and consequently to improve the image density and the reading precision.

Furthermore, a fourth aspect of the present invention provides a manufacturing method of developer for MICR printers, which comprises the steps of forming a toner base particle by mixing a binder resin and magnetic powder, adding metal oxide particles having a volume resistivity of $1\times10^5$ to $1\times10^{11}$ Ω·cm to the outer surface of the toner base particle to form a MICR toner, and mixing the MICR toner and a carrier.

Moreover, upon carrying out the manufacturing method of the developer for MICR printers, the metal oxide particles are preferably fixed to the outer surface of the toner base particle by using a fluidizing mixer, a mechanical fixing device, a high-speed air-flow impact fixing device or a thermal fixing device.

The application of each of these fixing devices makes it possible to easily fix the metal oxide particles onto the outer surface thereof with a part of each particle being exposed, and consequently to provide better controls on the abrasive effects and conductivity of the MICR toner.

Furthermore, a fifth aspect of the present invention provides a magnetic toner for MICR printers, which is obtained through the manufacturing method of the second embodiment.

Moreover, in accordance with the MICR toner of the present invention and the developer containing the MICR toner, the metal oxide particles, which have a volume resistivity of $1\times10^5$ to $1\times10^{11}$ Ω·cm, are fixed onto the outer surface of the MICR toner; thus, it is possible to provide superior abrasive effects and charge adjusting effects so that, for example, even after 150,000 to 300,000 sheets of A-4 paper have been continuously printed, it is still possible to provide superior image density and reading precision with respect to MICR fonts.

Furthermore, in the case of the MICR toner and developer in accordance with the present invention, even when applied to an amorphous silicon photosensitive member, etc., having a hydrophilic SiC surface, they make it possible to provide particular abrasive effects and superior conductivity controlling functions so that the MICR toner itself is allowed to scrape MICR toner remaining on the photosensitive member, and also to effectively prevent a so-called image blurring phenomenon.

In accordance with the manufacturing method of MICR toner and developer of the present invention, it is possible to efficiently provide MICR toner and developer which, for example, even after 150,000 to 300,000 sheets of A-4 paper have been continuously printed, still make it possible to provide superior image density and reading precision.

DETAILED DESCRIPTION OF THE PREFERRED EMBODIMENT

Figure 1:
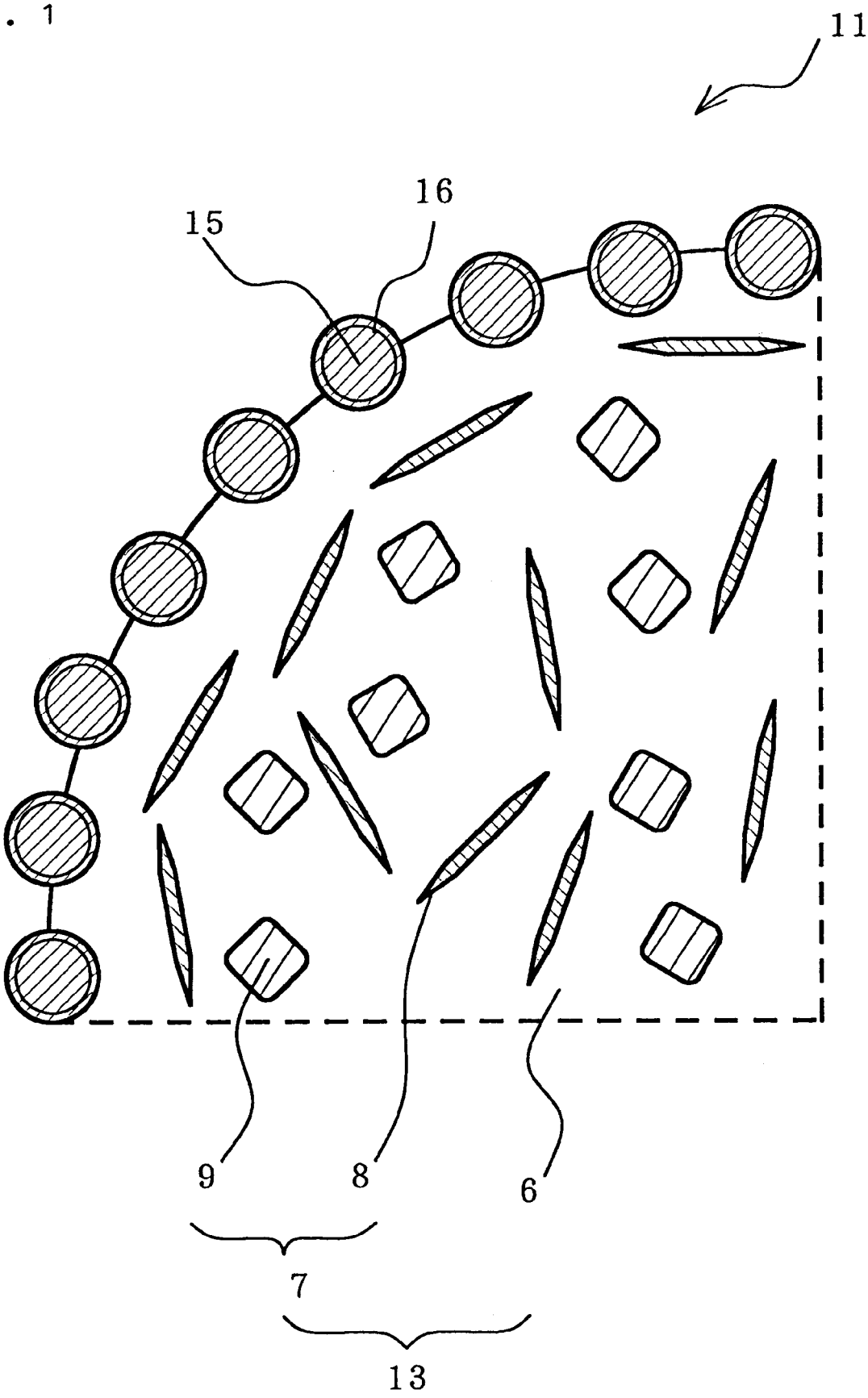
FIG. 1 is a schematic view that explains MICR toner.

The following description will discuss in detail embodiments related to a magnetic toner for MICR printers (first Embodiment) and a manufacturing method thereof (second Embodiment), a developer for MICR printers (third Embodiment) and a manufacturing method thereof (fourth Embodiment), and an image-forming method (fifth Embodiment) using the magnetic toner for MICR printers or the developer for MICR printers of the present invention.

[First Embodiment]

First Embodiment of the present invention relates to a magnetic toner for MICR printers, which comprises metal oxide particles that are in the outer surface of each particle-shaped product composed of a binder resin and magnetic powder, with the metal oxide particles having a volume resistivity of $1\times10^5$ to $1\times10^{11}$ Ω·cm.

The following description will discuss the magnetic toner for MICR printers that is first Embodiment of the present invention in detail, with respect to the binder resin, magnetic particles and metal oxide particles that are essential components, and additive components such as waxes and silica particles, as well as the shape and features of the resulting toner.

[Binder Resin]

(1) Kinds

The kinds of the binder resin used for the MICR toner of the present invention are not particularly limited; and, examples thereof include thermoplastic resins such as styrene resins, acrylic resins, styrene-acrylic copolymers, polyethylene resins, polypropylene resins, vinyl chloride resins, polyester resins, polyamide resins, polyurethane resins, polyvinyl alcohol resins, vinyl ether resins, N-vinyl resins and styrene-butadiene resins; and it is preferable to use one kind of these or combination of two or more kinds of these.

The above-mentioned thermoplastic resins are used so that it is possible to provide a superior fixing property in the resulting MICR toner.

Here, preferably, a cross-linked structure may be introduced to the binder resin, as long as the amount of a cross-linked portion (gel amount), measured by a Soxlet extractor, is not more than 10% by weight, more preferably, in the range of 0.1 to 10% by weight; thus, it is possible to improve the shelf-life stability, shape-retaining property or durability of the MICR toner.

(2) Functional Groups in the Binder Resin

Moreover, in the above-mentioned binder resin, in order to improve the dispersing property of the magnetic powder, it is preferable to use a resin which contains in its molecule at least one functional group selected from the group consisting of a hydroxyl group, a carboxyl group, amino group and glycidoxy group (epoxy group).

(3) Molecular Weight of Binder Resin

Moreover, the binder resin has preferably two weight molecular weight peaks (referred to as low-molecular weight peak and high-molecular weight peak). More specifically, the low-molecular weight peak is in the range of 3,000 to 20,000, and the other high-molecular weight peak is in the range of 300,000 to 1,500,000. When the weight molecular weight peaks are located in such ranges, it is possible to easily fix the MICR toner, and also to improve the offset resistant property.

Here, the weight molecular weight of the binder resin is measured by a molecular-weight measuring device (GPC).

(4) Glass Transition Point of the Binder Resin

Moreover, the binder resin has preferably a glass transition point (Tg) in the range of 55 to 70° C., and more preferably, in the range of 60 to 70° C.

This is because the glass transition point of the binder resin less than 55° C. causes the resulting toner particles to fuses with each other, resulting in degradation in the shelf-life stability. In contrast, the glass transition point of the binder resin exceeding 70° C. causes degradation in the fixing property of the MICR toner.

Here, the glass transition point of the binder resin can be measured by a differential scanning calorimeter (DSC) based upon a temperature-rising rate in 10° C./min under a nitrogen gas flow.

[Magnetic Powder]

(1) Kinds

The magnetic powder to be used in the MICR toner of the present invention is not particularly limited; and examples thereof include magnetic powder mainly composed of iron oxide (magnetite), iron powder, cobalt powder, nickel powder or ferrites, and magnetic powder formed by doping metal such as cobalt and nickel to iron oxide; and one kind of these may be used, or two or more kinds of these may be used in combination.

In particular, since the magnetic powder formed by doping a transition metal such as cobalt and nickel thereto has a high residual magnetization value, it is preferably applied to the present invention.

Here, in order to adjust the values of residual magnetization and dispersing property, etc., which will be described later, it is preferable to use, for example, two kinds of magnetic powders that have different residual magnetization values.

However, in the case where a two-component-type toner is used by adding a carrier to the MICR toner as shown in third Embodiment, it is also preferable to use only one kind of magnetic powder. This is because the fluidity and transporting property of the MICR toner can be controlled by the carrier.

(2) Residual Magnetization

In the magnetic powder, it is preferable to use at least two kinds of magnetic powders (referred to as first magnetic powder and second magnetic powder), wherein the first magnetic powder has a residual magnetization of 24 to 40 emu/g, and the second magnetic powder has a residual magnetization of 1 to 24 exclusive emu/g.

In this manner, by using at least two kinds of magnetic powders having different values in the residual magnetization in a mixed manner, it is possible to easily adjust the value of residual magnetization of the resulting MICR toner; thus, the fluidity, transporting property, developing characteristics, etc. of the MICR toner may be desirably controlled so that it becomes possible to greatly improve the image density and reading precision.

Moreover, by adjusting the value of the residual magnetization in such a range, it is also possible to easily adjust the aspect ratio, BET value, bulk density, etc. so that the dispersing property and durability of the magnetic powder are greatly improved with respect to the binder resin.

Therefore, in order to further improve the balance of characteristics of the dispersing property, the image density, etc. of the MICR toner, it is more preferable to set the residual magnetization of the first magnetic powder to a value of 25 to 38 emu/g, and to set the residual magnetization of the second magnetic powder to a value of 5 to 23 emu/g. Moreover, it is most preferable to set the residual magnetization of the first magnetic powder to a value of 26 to 35 emu/g, and to set the residual magnetization of the second magnetic powder to a value of 10 to 20 emu/g.

Here, with respect to the value of the residual magnetization, after having applied a magnetic field of 10 kilo oersted to magnetic powder, the magnetic field is set to zero, and the resulting quantity of magnetic memory is defined as the value. More specifically, the hysteresis curve of magnetic powder is measured under such a condition by using a magnetic force measuring device so that the residual magnetization of the magnetic powder can be calculated.

Moreover, in the case where a two-component-type toner is used by adding a carrier to the MICR toner as shown in third Embodiment, the fluidity and transporting property of the MICR toner can be controlled by the carrier; therefore, it is possible to reduce the amount of application of the magnetic powder required.

Therefore, by using a magnetic powder having a comparatively high value in the residual magnetization, that is, more specifically, those in the range of 25 to 38 emu/g, it becomes possible to obtain superior image density and reading precision even in the case of the application of one kind of magnetic powder.

(3) Saturated Magnetization

With respect to the magnetic powder, first magnetic powder and second magnetic powder having different values in the residual magnetization are prepared, and the saturated magnetization in the first magnetic powder is preferably set to a value of 80 to 85 emu/g, and the saturated magnetization in the second magnetic powder is also preferably a value of 85 to 90 emu/g (where 85 emu/g is not included).

The value of the saturated magnetization is closely related to the value of the residual magnetization, and at least two kinds of magnetic powders having different values in the saturated magnetization are used in a mixed manner as described above so that the value of the residual magnetization is finely adjusted, with the result that the image density and the reading precision in the resulting MICR toner can be improved. Moreover, by adjusting the values of the saturated magnetization in such ranges so that it is possible to easily adjust the aspect ratio, BET value, bulk density, etc. of the magnetic powder; thus, the dispersing property and durability of these magnetic powders can be improved with respect to the binder resin.

Therefore, in order to further improve the balance of characteristics of the dispersing property, the image density, etc. of the MICR toner, it is more preferable to set the saturated magnetization of the first magnetic powder to a value of 81 to 84 emu/g, and to set the saturated magnetization of the second magnetic powder to a value of 86 to 89 emu/g. Moreover, it is most preferable to set the saturated magnetization of the first magnetic powder to a value of 82 to 83 emu/g, and to set the saturated magnetization of the second magnetic powder to a value of 87 to 88 emu/g.

Here, with respect to the value of the saturated magnetization, after having applied a magnetic field of 10 kilo oersted to magnetic powder, the magnetic field is set to zero, and the resulting quantity of magnetic memory is defined as the value. More specifically, in the same manner as the residual magnetization, the hysteresis curve of magnetic powder is measured so that the saturated magnetization of the magnetic powder can be calculated.

(4) Aspect Ratio With respect to the aspect ratio (major axis/minor axis) of magnetic powder, in the case where magnetic powders having different residual magnetization values are prepared as the first and second magnetic powders, it is preferable to set the aspect ratio (major axis/minor axis) of the first magnetic powder to a value of 2.0 to 100 (–), and to set the aspect ratio (major axis/minor axis) of the second magnetic powder to a value of 1.0 to 2.0 exclusive (–).

In this manner, with the aspect value 2.0 being set to a reference, one magnetic powder located within a predetermined range above the value and the other magnetic powder located within a predetermined range less than the value are mixedly used; thus, it becomes possible to greatly improve the dispersing property of these magnetic powders with respect to the binder resin. Moreover, since the dispersing property of the magnetic powder is improved, the magnetic powder is less likely to form clumps. Therefore, the MICR toner is less susceptible to cracking, and separation of magnetic powder so that it becomes possible to greatly improve the durability of the MICR toner. Moreover, since the magnetic toner having a great aspect ratio has a great value in the residual magnetization, the application of the MICR toner having such magnetic powder blended therein makes it possible to improve the image density and reading precision.

Therefore, in order to further improve the balance of characteristics of the dispersing property, the printing density, etc. of the MICR toner, it is more preferable to set the aspect ratio of the first magnetic powder to a value of 2.5 to 10.0 (–), and to set the aspect ratio of the second magnetic powder to a value of 1.2 to 1.7 (–). Moreover, it is most preferable to set the aspect ratio of the first magnetic powder to a value of 3.0 to 5.0 (–), and to set the aspect ratio of the second magnetic powder to a value of 1.3 to 1.6 (–).

(5) BET Value

Moreover, with respect to the BET value of magnetic powder, in the case where magnetic powders having different residual magnetization values are prepared as the first and second magnetic powders, it is preferable to set the BET value of the first magnetic powder to a value of 10 to 30 m/g, and to set the BET value of the second magnetic powder to a value of 1 to 10 exclusive $m^2/g$.

In this manner, by using at least two kinds of magnetic powders having different BET values in a mixed manner, it is possible to easily adjust the value of residual magnetization and the dispersing property of the resulting MICR toner. Moreover, such an arrangement makes it possible to greatly improve the image density and the reading precision in the MICR toner, and also to greatly improve the dispersing property and the durability of these magnetic powders with respect to the binder resin.

Therefore, in order to further improve the balance of characteristics of the dispersing property, the image density, etc. of the MICR toner, it is more preferable to set the BET value of the first magnetic powder to a value of 11 to 25 $m^2/g$, and to set the BET value of the second magnetic powder to a value of 2 to 9 $m^2/g$. Moreover, it is most preferable to set the BET value of the first magnetic powder to a value of 12 to 20 $m^2/g$, and to set the BET value of the second magnetic powder to a value of 4 to 8 $m^2/g$.

Here, the BET value is obtained by the BET adsorption method as a specific surface area.

(6) Bulk Density

With respect to the bulk density of magnetic powder, in the case where magnetic powders having different residual magnetization values are prepared as the first and second magnetic powders, it is preferable to set the bulk density of the first magnetic powder to a value of 1 to 1.2 $g/cm^3$, and to set the bulk density of the second magnetic powder to a value of 1.2 to 2.0 $g/cm^3$ (where 1.2 $g/cm^3$ is not included).

In this manner, by using at least two kinds of magnetic powders having different bulk densities in a mixed manner, it is possible to easily adjust the value of residual magnetization and the dispersing property of the resulting MICR toner. Moreover, such an arrangement makes it possible to greatly improve the image density and the reading precision in the MICR toner, and also to greatly improve the dispersing property and the durability of these magnetic powders with respect to the binder resin.

Therefore, in order to further improve the balance of characteristics of the dispersing property, the image density, etc. of the MICR toner, it is more preferable to set the bulk density of the first magnetic powder to a value of 1.05 to 1.2 $g/cm^3$, and to set the bulk density of the second magnetic powder to a value of 1.3 to 1.6 $g/cm^3$. Moreover, it is most preferable to set the bulk density of the first magnetic powder to a value of 1.1 to 1.2 $g/cm^3$, and to set the bulk density of the second magnetic powder to a value of 1.3 to 1.5 $g/cm^3$.

(7) Shape

Moreover, the shape of the magnetic powder is not particularly limited; and magnetic powder having a shape, such as a needle shape, a granular shape or a spherical shape, or irregular shapes, may be used.

Here, magnetic powder having a needle shape generally has small values in the bulk density and saturated magnetization so that it is poor in the dispersing property in the binder resin; however, it is characterized by high values of the residual magnetization, the coercive force, the BET value and the aspect ratio (major axis/minor axis).

Moreover, magnetic powder having a granular shape generally has comparatively great values in the residual magnetization, the saturated magnetization, the coercive force and the BET value; however, it has comparatively small values in the aspect ratio (major axis/minor axis) and the bulk density, and is characterized in that the dispersing property is superior with respect to the binder resin.

Furthermore, although the magnetic powder having a granular shape generally has small values in the residual magnetization, the coercive force, the BET value and the aspect ratio (major axis/minor axis), it has comparatively great values in the bulk density and the saturated magnetization, and is characterized in that the dispersing property is superior with respect to the binder resin.

Moreover, in the present invention, in the case where magnetic powders having different residual magnetization values are prepared as the first and second magnetic powders, it is preferable to allow the first magnetic powder to have a needle shape and also to allow the second magnetic powder to have a granular shape.

The reason for this is that the application of at least two kinds of magnetic powders having different shapes mixed with each other makes it possible to easily adjust the residual magnetization and the dispersing property of the resulting toner.

In other words, the magnetic powder having a needle shape generally has a problem in which the dispersing property is poor and the value of the saturated magnetization is small, although the value of the residual magnetization and the value of the BET surface area are great. In contrast, the magnetic powder having a granular shape generally has a problem in which the value of the residual magnetization and the value of the BET surface area are comparatively small, although the dispersing property is superior and the value of the saturation magnetization is great.

Therefore, even when either the magnetic powder having a needle shape or the magnetic powder having a granular shape is used, it is sometimes difficult to obtain a well-balanced toner because of its contradictory properties such as the residual magnetization and the dispersing property.

In contrast, the application of the magnetic powders mixed in this manner makes it possible to greatly improve the image density and the reading precision, and also to easily improve the dispersing property and the durability of these magnetic powders with respect to the binder.

(8) Amount of Addition

Moreover, the amount of addition of the magnetic powder is not particularly limited; and, for example, it is preferably set in the range of 1 to 60 parts by weight, more preferably, in the range of 40 to 60 parts by weight, with respect to 100 parts by weight of the binder resin.

The reason for this is that the amount of addition of the magnetic powder less than one part by weight tends to cause so-called fog and degradation in the readability. In contrast, the amount of addition of the magnetic powder exceeding 60 parts by weight causes degradation in the dispersing property and stirring property, and also results in degradation in the image density, etc.

Therefore, in order to provide a better balance between the image density, etc. and the dispersing property, etc. of the MICR toner, the amount of addition of the magnetic powder is preferably 20 to 55 parts by weight, more preferably, 30 to 50 parts by weight, with respect to 100 parts by weight of the binder resin.

Next, an explanation will be given of the ratio of addition of these magnetic powders, in the case where magnetic powders having different values in the residual magnetization are provided as the first and second magnetic powders. In other words, the ratio of addition of these magnetic powders are not particularly limited; however, when the amount of the first magnetic powder is set to 100 parts by weight, the amount of the second magnetic powder is preferably 10 to 1,000 parts by weight.

The reason for this is that the amount of addition of the second magnetic powder less than 10 parts by weight tends to cause degradation in the dispersing property in the magnetic powder and also degradation in the durability in the MICR toner; in contrast, the amount of addition of the second magnetic powder exceeding 1,000 parts by weight tends to cause degradation in the image density, etc. in the MICR toner.

Therefore, in the case where the addition of the first magnetic powder is set to 100 parts by weight, the addition of the second magnetic powder is preferably set to a value of 20 to 500 parts by weight, more preferably, a value of 50 to 300 parts by weight.

(9) Surface Treatment

Next, an explanation will be given of the surface treatment of the magnetic powder. In order to improve the dispersing property of the magnetic powder and the durability of the MICR toner, both of the above-mentioned first and second magnetic powders, or either one of these, are preferably subjected to a surface treatment by using a surface modifying agent. In this case, examples of the surface modifying agent include: cationic surfactants, anionic surfactants, amphoteric surfactants, silane coupling agents, titanium coupling agents, aluminum coupling agents, phenolic resins, epoxy resins, cyanate resins, urethane resins, etc., and one of these may be used alone, or two or more kinds of these may be used in combination.

Moreover, the use of the surfactant is preferably set to a value of 0.1 to 100 parts by weight with respect to 100 parts by weight of the magnetic powder. The use of the surfactant less than 0.1 parts by weight tends to cause insufficient surface treatment effects, and the use of the surfactant exceeding 100 parts by weight tends to cause degradation in the image density, etc. of the toner.

Therefore, in order to provide a better balance between the surface treatment effects and the image density, etc. of the MICR toner, the use of the magnetic powder is preferably set to a value of 0.5 to 20 parts by weight, more preferably, a value of 1.0 to 10 parts by weight, with respect to 100 parts by weight of the magnetic powder.

[Metal Oxide Particles]

The first embodiment is characterized in that metal oxide particles are added onto the outer surface of each base particle. Referring to FIG. 1, an explanation will be given of these metal oxide particles (conductive abrasive-agent fine particles) 15.

FIG. 1 is a drawing that partially shows a model of MICR toner containing metal oxide particles on the outer surface thereof, and this shows a state in which the MICR toner 11 is composed of a toner base particle 13, made of a binder resin 6 and two kinds of magnetic powders 8 and 9, on the outer surface of which metal oxide particles 15 are fixed with a part of which being exposed.

Moreover, in addition to the metal oxide particles 15 in FIG. 1, a surface treatment layer 16 is shown so as to indicate that the surface has been subjected to a surface treatment for conductivity.

The following description will discuss the kinds, the volume resistivity and properties of such metal oxide particles 15, in detail.

(1) Kinds

With respect to the kinds of the metal oxide particles, examples thereof include fine particles having high hardness, such as aluminum oxide (alumina), titanium oxide (titania) and zirconium oxide (zirconia); and one of these may be used alone, or two or more kinds of these may be used in combination.

More preferably, among these metal oxide particles, aluminum oxide and titanium oxide, or either one of these, may be preferably used.

For example, titanium oxide and aluminum oxide have a high white-color demonstrating property; thus, these are preferably used because, even when these are used for the MICR toner, they are less likely to cause discoloration in the original color of the MICR toner when printed. Moreover, these metal oxide particles are chemically stable, and are superior in the heat resistance; thus, these are preferably used because they are less susceptible to degradation even when, after exposure, the resulting visible image is thermally fixed.

Here, titanium oxide which is a rutile type in its crystal structure is superior in the abrasive property to anatase-type titanium oxide so that it is more preferably used.

(2) Volume Resistivity

① Range

It is necessary to set the volume resistivity of the metal oxide particles to a value of $1\times10^5$ to $1\times10^{11}$ Ω·cm, more preferably, a value of $1\times10^6$ to $1\times10^{10}$ Ω·cm, most preferably, a value of $1\times10^7$ to $1\times10^9$ Ω·cm.

Figure 4:
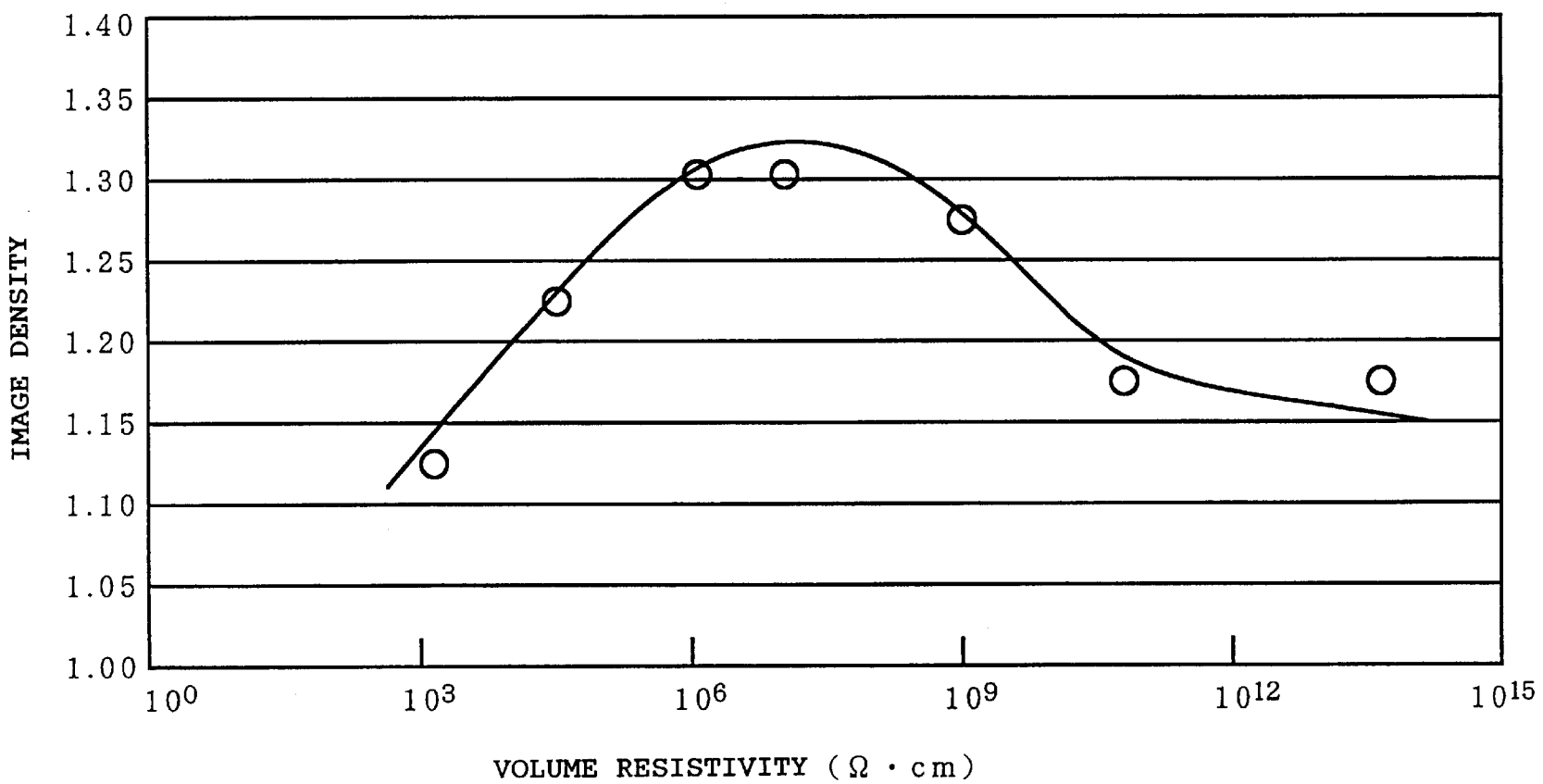
FIG. 4 is a drawing that shows the relationship of a volume resistivity of metal oxide particles, an image density and a reading rate.

Referring to FIG. 4, the reason for this is explained, more specifically. FIG. 4 shows a part of data in Examples 1, 2, Comparative Examples 1, 2 and Examples 9 and 10 as well as Comparative Examples 7, 8; and in this Figure, the volume resistivity (Ω·cm) of the metal oxide particles in the MICR toner are plotted on the axis of abscissa; the value of the image density, obtained when 300,000 sheets of A-4 paper have been printed from an image evaluation pattern made from MICR font (E-13B) by using the corresponding MICR toner, is plotted on the left-side longitudinal axis; and the reading rate (%), obtained when 150,000 sheets of A-4 paper have been printed from the image evaluation pattern made from MICR font (E-13B) by using a developer for MICR printers that contains the MICR toner, is plotted on the right-side longitudinal axis.

Here, the value of the image density is obtained by using a Macbeth densitometer, and for example, in the case of a sheet of A-4 paper in an unprinted state (in some cases, indicated as "white"), 0.07 is set as a reference value, while in the case of an image evaluation pattern in a solid printed state, the value is 1.78.

As clearly shown by FIG. 4, when the volume resistivity of the metal oxide particles to be used becomes not less than 1×10 Ω·cm, it is possible to obtain a value of image density of approximately not less than 1.23 and a high reading rate of approximately not less than 80%, even after long-term continuous printing operations. This is because, in contrast, the volume resistivity of the metal oxide particles of less than $1\times10^5$ Ω·cm causes an excessive reduction in the quantity of charge, thereby making toner having large diameters stuck therein.

In contrast, as indicated by FIG. 4 in the same manner, in the case of the volume resistivity of the metal oxide particles to be used of not more than $1\times10^{11}$ Ω·cm, it is possible to obtain a value of image density of approximately not less than 1.23 and a high reading rate of approximately not less than 80%, even after long-term continuous printing operations. This is because, in contrast, the volume resistivity of the metal oxide particles exceeding $1\times10^{11}$ Ω·cm causes an excessive increase in the quantity of charge, thereby resulting in charging-up and the subsequent accelerated selective development.

Therefore, by setting the volume resistivity of the metal oxide particles to a value of $1\times10^5$ to $1\times10^{11}$ Ω·cm, it is possible to allow them to effectively exert the conductivity controlling functions, and consequently to provide superior image density and a higher reading rate, even after long-term continuous printing operations.

② Measuring Method

The volume resistivity of the metal oxide particles is measured as follows: Sample metal oxide particles are sandwiched between upper and lower electrodes (electrode area 5 $cm^2$), and this is pressed under a condition of an applied load of 1 kg so as to adjust the electrode-to-electrode distance to 0.5 cm; then, a voltage of 1 to 500 V is applied between the electrodes so that the value of a current flowing is measured, and converted to provide the value.

Here, with respect to the carrier volume resistivity, which will be described later, the measurements can be carried out in the same method.

③ Adjusting Method

Here, the volume resistivity of the metal oxide particles is easily adjusted to a value of $1\times10^5$ to $1\times10^{11}$ Ω·cm by applying a conductivity-adjusting treatment, such as a tin oxide treatment or an indium oxide treatment, to the kinds of metal oxide particles as described above.

For example, the metal oxide particles and the conductivity treatment agent are respectively housed in a mixing device such as a Henschel mixer, and stirred and mixed; thus, the volume resistivity of the metal oxide particles can be adjusted by the amount of the conductivity treatment agent adhering to the particles.

More specifically, the amount of the conductivity treatment agent to be processed is preferably set to a value of 0.01 to 10% by weight, more preferably, a value of 0.05 to 5% by weight, with respect to the entire amount.

(3) Hardness

Moreover, the hardness of the metal oxide particles is preferably set to a value of 5 to 7.5 in Moh's hardness.

The reason for this is that the Moh's hardness of the metal oxide particles of less than 5 causes a difficulty in exerting superior abrasive effects on the photosensitive member, and that the Moh's hardness exceeding 7.5 tends to exert the abrasive effects even on the members such as the amorphous silicon photosensitive member and the transport rollers.

Here, even in the case where an amorphous silicon photosensitive member (α-Si photosensitive member) having a silicon carbide (SiC) layer as a surface protective layer 21 (see FIGS. 2 and 3) of the photosensitive member is subjected to the abrasive process; it is still preferable to set the Moh's hardness of the metal oxide particles to a value 6 to 7.5.

(4) Average Particle Size

Moreover, the average particle size of the metal oxide particles is preferably set to a value of 50 nm to 1 μm.

The reason for this is that the average particle size of the metal oxide particles of less than 50 nm tends to cause a difficulty in exerting abrasive effects, and that the average particle size exceeding 1 μm causes a difficulty in fixing the particles in a state where a part thereof is exposed, resulting in separation of the metal oxide particles.

Therefore, in order to provide a better balance between the abrasive effects and the prevention of separation of the metal oxide particles, the average particle size of the metal oxide particles is preferably set to a value of 100 nm to 900 nm, more preferably, a value of 200 nm to 800 nm.

Moreover, in order to obtain a uniform abrasive force, it is preferable to set the grain distribution of the metal oxide particles to a narrow range; and more specifically, with respect to the grain distribution measured by a grain distribution meter, it is preferable to allow 80% by weight of the weight of the particles to be located within the range of ±100 nm of the average particle size.

Furthermore, in order to make the fixing of the metal oxide particles easier, on the assumption that the average particle size of the metal oxide particles is d and the average particle size of the toner base particles is D, it is preferable to set D/d to a value of 10 to 500, more preferably, a value of 50 to 300.

(5) Amount of Addition

Moreover, it is preferable to set the addition of the metal oxide particles to a value of 0.5 to 2% by weight, with respect to the entire amount.

The reason for this is that the addition of the metal oxide particles of less than 5% by weight makes it difficult to exert sufficient abrasive effects, or makes it difficult to adjust the conductivity in a stable manner. In contrast, the addition thereof exceeding 2% by weight also makes it difficult to adjust the conductivity in a stable manner, and results in separation of the metal oxide particles.

Therefore, in order to provide a better balance among the prevention of separation of the metal oxide particles, the abrasive effects and the adjustments in the conductivity stability, the addition of the metal oxide particles is preferably set to a value of 1 to 1.5% by weight, more preferably, a value of 1.3 to 1.4% by weight.

With respect to this point, an explanation will be further given based upon the results of examinations on the addition of metal oxide particles (titanium oxide) to the MICR toner shown in the following Table 1.

In other words, in the MICR toner in Example 1 and Example 9, the addition of titanium oxide was varied within the range of 0.1 to 5% by weight to form MICR toners; and printing tests (Example 1: A-4 paper, 50,000 sheets, Example 9: A-4 paper, 150,000 sheets) were carried out, and the results were evaluated on the conductivity stability and separation susceptibility based upon the following references.

(Evaluation on Conductivity Stability)

◎: Neither selective developing nor toner adhesion was found.

○: Selective developing and toner adhesion were found only slightly.

Δ: Selective developing and toner adhesion were found slightly

X: Much selective developing and toner adhesion were found clearly.

(Evaluation on Separation Susceptibility)

◎: No separation of metal oxide particles from MICR toner was found.

○: Separation of metal oxide particles from MICR toner was found only slightly.

Δ: Separation of metal oxide particles from MICR toner was found slightly.

X: Much separation of metal oxide particles from MICR toner was found clearly.

TABLE 1

| Addition wt % | 0.1 | 0.5 | 1.0 | 1.5 | 3.0 | 5.0 |
|---|---|---|---|---|---|---|
| Conductivity | Δ | Δ | ◎ | ◎ | Δ | Δ |
| Separation susceptibility | ◎ | ◎ | ◎ | ◎ | Δ | Δ |

Therefore, since the results of evaluations were superior with respect to the prevention of separation of the metal oxide particles and the adjustments in the conductivity stability, it is understood that the addition of the metal oxide particles is preferably set to a value of 1 to 1.5% by weight.

(6) Degree of Exposure

With respect to the degree of exposure of the metal oxide particles, the volume of the metal oxide particle sticking outside the toner base particle is preferably set to a value of 10 to 90% by volume of the volume of the metal oxide particle defined as 100% by volume.

The reason for this is that the degree of exposure of the metal oxide particle of less than 10% by volume tends to cause a difficulty in exerting sufficient abrasive effects, and that, in contrast, the degree of exposure exceeding 90% by volume causes the metal oxide particles to easily separate from the base particle.

Therefore, in order to provide a better balance between the prevention of separation of the metal oxide particles and the abrasive effects thereof, the degree of exposure of the metal oxide particles is preferably set to a value of 20 to 80% by volume, more preferably, a value of 30 to 40% by volume.

[Additive Agents]

(1) Waxes

With respect to the magnetic toner for MICR printers of the present invention, in order to increase the image density and to effectively prevent offsets onto the reading head and image smearing, it is preferable to add waxes thereto.

Examples of preferable waxes include polyethylene wax, polypropylene wax, Teflon waxes, Fischer Tropsch wax, etc.

Here, the addition of waxes is preferably set to a value of 1 to 5% by weight of the entire amount of toner defined as 100%. The reason for this is that the addition of waxes of less than 1% by weight tends to cause a difficulty in effectively preventing offsets onto the reading head and image smearing, and that, in contrast, the addition of waxes exceeding 5% by weight causes isolation of waxes, and the subsequent adhesion to the surface of the photosensitive drum and a reduction in the density, or fusing between toner particles and the subsequent degradation in the shelf-life stability and filming.

(2) Charge Controlling Agent

Moreover, in order to improve the charging level and charge rising property (index indicating whether or not the toner is charged to a predetermined charge level in a short time) and also to provide superior fluidity, a charge controlling agent is preferably added to the MICR toner.

Here, with respect to the charge controlling agents, there are charge adjusting agents (CCA) having a function for adjusting a charge (quantity of charge) to a predetermined level and charge increasing resins (CCR) having a function for increasing a charge (quantity of charge). Therefore, in the present invention, it is preferable to add both of the charge adjusting agent and the charge increasing resin, or either of these, to the MICR toner.

More specifically, examples of preferable charge adjusting agents (CCA) include: azine compounds, direct dyes made from azine compounds, nigrosine compounds, metal salts, alkoxylated amine, alkyl amid, quaternary ammonium salt; and one kind of these may be used alone, or two or more kinds of these may be used in combination. In particular, the nigrosine compound allows the quantity of charge to instantaneously rise, and the saturated quantity of charge thereof is easily controlled so that it is most preferably applied to the present invention.

Moreover, with respect to the preferable charge increasing resins (CCR), resin or oligomer having a quaternary ammonium salt, resin or oligomer having a carboxylic acid and resin or oligomer having a carboxylic group; and one kind of these may be used alone, or two or more kinds of these may be used in combination. In particular, the application of a styrene-acrylic co-polymer containing a quaternary ammonium salt, a carboxylic acid salt, or a carboxylic group makes it possible to accelerate the rising property of the charge; thus, this is most preferably applied to the present invention.

Moreover, the addition of the charge controlling agent is preferably set to a value of 0.1 to 10% by weight of the entire MICR toner defined as 100% by weight.

The reason for this is that the addition of the charge controlling agent of not less than 0.1% by weight tends to cause a difficulty in effectively exerting the charge controlling function, and that, in contrast, the addition of the charge controlling agent exceeding 10% by weight tends to cause degradation in the toner dispersing property and durability.

(3) Internally Additive Agents

Moreover, to the MICR toner of the present invention, in addition to the above-mentioned waxes and charge controlling agents, other internally additive agents, such as colorants, dyes, pigments, coupling agents and silica particles, may be preferably blended.

(4) Externally Additive Agent

Moreover, to the MICR toner of the present invention, an externally additive agent may be preferably added so as to more effectively control the fluidity. With respect to the externally additive agent, silica particles (silica fine powder) are preferably added.

In this case, dry-type silica fine powder and wet-type silica fine powder are preferably added in combination. The application of the different kinds of silica fine particles in a combined manner makes it possible to effectively prevent the charging property of the MICR toner from being influenced by environmental conditions (humidity condition).

Moreover, it is preferable to set the addition of the externally additive agent to a value of 0.1 to 5 parts by weight of the MICR toner defined as 100 parts by weight.

The reason for this is that the addition of less than 0.1 parts by weight tends to cause degradation in the toner fluidity, and the subsequent degradation in the image density. In contrast, the addition exceeding 5 parts by weight results in degradation in the durability of the MICR toner and failure to control the charge.

Therefore, it is more preferable to set the addition of the externally additive agent to a value in 1 to 3 parts by weight.

[MICR Toner]

(1) Residual Magnetization

In the present invention, it is preferable to set the residual magnetization of the MICR toner to a value within 7.0 to 20 emu/g (where 7.0 emu/g is not included).

The reason for this is that the residual magnetization in the MICR toner of less than 7.0 emu/g causes an extreme reduction in the image density and the reading precision in the MICR toner, and that, in contrast, the residual magnetization in the MICR toner exceeding 20 emu/g causes an extreme increase in the signal level in the reading precision of the MICR toner, resulting in failure in detection and degradation in the dispersing property and durability.

Therefore, in order to obtain further superior reading precision, etc. of the MICR toner, it is more preferable to set the residual magnetization to 8 to 18 emu/g, most preferably, 9 to 15 emu/g, by far the most preferably, 10 to 15 emu/g.

(2) Saturated Magnetization

Next, an explanation will be given of the value of the saturated magnetization of the MICR toner. The saturated magnetization of the MICR toner is not intended to be limited by a specific value; however, for example, it is preferable to set this to 20 to 45 emu/g. The saturated magnetization in the MICR toner of less than 20 emu/g tends to cause extreme degradation in the image density and reading precision, and in contrast, the value of the saturated magnetization in the MICR toner exceeding 45 emu/g tends to cause degradation in the reading precision.

Therefore, in order to obtain better reading precision of the MICR toner, it is more preferable to set the saturated magnetization of the MICR toner to 25 to 40 emu/g, most preferably, 30 to 32.5 emu/g.

(3) Shape and Average Particle Size

The shape of the MICR toner is not particularly limited, either; however, in order to improve the reading precision of the toner and the image density and also to easily manufacture it, the shape is preferably set to a spherical shape or a granular shape.

Moreover, it is preferable to set the average particle size of the MICR toner to 1 to 20 $\mu$m.

The reason for this is that the average particle size outside of this range tends to cause degradation in the reading precision of the toner and the image density, and also to result in a difficulty in carrying out the manufacturing processes.

Therefore, the average particle size of the MICR toner is more preferably set to 4 to 15 $\mu$m, most preferably, 5 to 13 $\mu$m, by far the most preferably, 6 to 8 $\mu$m.

[Second Embodiment]

The second embodiment relates to a manufacturing method of MICR toner, which comprises steps of forming a toner base particle by mixing a binder resin and magnetic powder, and adding metal oxide particles onto the outer surface of the toner base particle, the metal oxide particles having a voltage resistivity of $1\times10^5$ to $1\times10^{11}$ Ω·cm.

(1) Toner Base Particle Forming Process

The toner base particle forming process is a process in which the binder resin and the magnetic powder are mixed and molded into spherical toner base particles.

The manufacturing method for such toner base particles is not particularly limited; and, for example, by using a propeller mixer, a kneader, a V blender, a Henschel mixer, etc., the binder resin and the magnetic powder are uniformly kneaded, and this is ground by a grinder, and further classified so that spherical toner base particles having a desired average particle size are obtained.

Moreover, at this point, the above-mentioned waxes and internally additive agents such as charge controlling agents are preferably added thereto.

Here, more specifically, taking into consideration the average particle sizes of the MICR toner and the metal oxide particles, the average particle size of the toner base particles is preferably set to 0.5 to 18 μm, more preferably, 0.8 to 15 μm.

(2) Process of Adding Metal Oxide Particles

The process of adding metal oxide particles is a process in which the metal oxide particles are fixed onto the surface of the toner base particles, with a part being exposed therefrom, to form a MICR toner. In other words, the toner base particles and the metal oxide particles are mixed with each other uniformly, and after the metal oxide particles have been allowed to adhere to the surface of the toner base particle by using, for example, an electrostatic force, the metal oxide particles are embedded into the toner base particle by applying a mechanical or thermal impact force through a fixing device, etc.

With respect to the fixing device used in this process, those devices that are commercially available as surface-modifying devices and surface-modifying systems may be used; and examples thereof include: a Henschel Mixer (trade name) made by Mitsui Mining Co., Ltd., which is a typical fluidizing mixer, and a Mechano Chemical (trade name) made by Okada Seiko Co., and a Mechano Fusion System (trade name) made by Hosokawa Micron K.K., which are mechanical fixing devices (dry-type mechano-chemical method).

Moreover, with respect to high-speed air-flow impact type fixing devices, a Hybridization System (trade name) made by Nara Kikai Seisakusho Co., and a Cryptron System (trade name) made by Kawasaki Heavy Industries, Ltd. are listed.

Moreover, with respect to thermal fixing devices, a Surfusing System (trade name) made by Nippon Pneumatic MFG. is listed.

Here, the treatment conditions in these fixing devices may be properly determined by taking into consideration the fixing conditions of the metal oxide particles; and, for example, in the case where 1% by weight of metal oxide particles are fixed with respect to 50 Kg of toner by using the above-mentioned Henschel Mixer, as indicated by the results shown in Table 2, it is preferable to set the number of revolutions to 1200 to 2000 rpm per 2 to 6 minutes, more preferably, 1400 to 1800 rpm per 1 to 6 minutes.

TABLE 2

| | Number of revolutions (rpm) | | |
|---|---|---|---|
| Stirring time | 1200 | 1600 | 2000 |
| 1 min. | X | ○ | X |
| 4 min. | ○ | ○ | ○ |
| 7 min. | Δ | Δ | X |

○: Metal oxide particles were fixed with a part being exposed.
Δ: Although metal oxide particles were fixed, the fixed state was not insufficient.
X: Metal oxide particles were not fixed.

[Third Embodiment]

The third Embodiment relates to a developer for MICR printers (hereinafter, referred to simply as developer) composed of the above-mentioned MICR toner and a carrier.

Here, in the present embodiment, the contents of the MICR toner contained in the developer are the same as those described in the first Embodiment; therefore, the description thereof is omitted. Accordingly, the following description will discuss the carrier.

[Carrier]

With respect to the carrier, a magnetic powder carrier or a resin-coat carrier may be used. Even in the case of a MICR toner having a very high specific gravity as compared with general printing toners, by blending such a carrier to the MICR toner, it is possible to provide a superior transporting property, and consequently to easily set the image density to a constant value.

1. Resin Coat Carrier (1) Carrier Core Member

With respect to a material for a resin core carrier, any carrier core member which has been used in the known electrophotographic two-component carrier may be adopted; and, for example, the following materials are preferably used:

① metals such as ferrite, magnetite, iron, nickel and cobalt.

② alloys or mixtures of the above-mentioned metals and materials such as copper, zinc, antimony, aluminum, lead, tin, bismuth, beryllium, manganese, magnesium, selenium, tungsten, zirconium and vanadium.

③ mixtures of the above-mentioned metals, etc. and a metal oxide such as iron oxide, titanium oxide and magnesium oxide, a nitride such as chromium nitride and vanadium nitride, or a carbide such as silicon carbide and tungsten carbide.

④ ferromagnetic ferrite

Moreover, the shape of the carrier core member is not particularly limited, and either a spherical shape or irregular shapes may be used. However, it is preferable to use a spherical shape since this shape allows uniform charging with ease.

Furthermore, the average particle size of the carrier core member is preferably set to 20 to 120 μm, more preferably, 25 to 80 μm.

The reason for this is that the average particle size of the carrier core member of less than 20 μm tends to cause carrier adhesion (scattering) to the electrostatic latent image bearing member (in general, photosensitive member), and that, in contrast, the average particle size exceeding 120 μm tends to cause carrier lines, etc., and the subsequent degradation in the image characteristics (reduction in the image density).

Moreover, the rate of the carrier core member is preferably set to not less than 90% by weight, more preferably, 95 to 99% by weight, of the entire carrier defined as 100%.

The reason for this is that the rate of the carrier core member of less than 90% by weight tends to cause a reduction in the magnetic force and the resulting degradation in the toner transporting property. Here, the rate of the carrier core member is allowed to indirectly regulate the thickness of the carrier coat layer, and when the composition rate of the carrier core member becomes less than 90% by weight, the coat layer tends to become too thick or have an irregular thickness. For this reason, the application of this carrier to the developer causes problems such as separation of the coat layer and an increase in the quantity of charge, or failure to satisfy the durability and stability of charge required for the developer. Moreover, when the rate of the carrier core member of less than 90% by weight tends to cause degradation in fine line reproducing property in the image quality and a reduction in the image density.

Here, the upper limit of the composition rate of the carrier core member is preferably set so as to allow the coat resin layer to completely cover the carrier core member and the magnetic powder, and more specifically, it is preferably set to not more than 99.5% by weight, more preferably, not more than 99.0%.

(2) Coat Layer

The resin forming the coat layer of the resin-coat carrier is made from, for example, a polyethylene resin or a polypropylene resin, etc., and the number average molecular weight is preferably set to not less than 10,000 (or not less than 50,000 in weight average molecular weight), and the number average molecular weight is more preferably set to 40,000 to 200,000 (or in the range of 200,000 to 1000,000 in weight average molecular weight).

The reason for this is that the number average molecular weight less than 10,000 tends to cause a reduction in the mechanical strength, and the subsequent separation from the carrier core member due to shearing forces, etc., in the developing device, when it is used for a long time.

Here, it is preferable to add to the coat layer a functional resin made from one kind of or a combination of two or more kinds of conductive fine particles and electricity resistant fine particles having a charge controlling function.

Moreover, with respect to the formation method of the coat layer, for example, a method selected from the group consisting of a direct polymerization method, a dipping method, a fluidizing floor, a dry method and a spray drying method; and it is more preferable to use the direct polymerization method.

The direct polymerization method is a method in which: the surface of the carrier core member is preliminarily treated with a polymerization catalyst, and the coat layer is formed while the monomer such as ethylene is directly polymerized (formed) on the surface of the carrier core member. In this formation method, the coat layer made from polyethylene, etc. is directly formed in the inside as well as on the surface of the carrier core member so that the resulting coat layer becomes thinner and is allowed to have superior strength and elasticity. For example, the application of the direct polymerization method makes it possible to set the weight ratio [high molecular polyethylene resin coat]/[carrier core member particles] to 0.5/99.5 to 10/90, more preferably, 1/99 to 5/95.

Moreover, in accordance with the direct polymerization method, only by using a simple process for allowing the dispersed conductive particles, etc., to be polymerized, the conductive particles, etc., are taken into the coat layer to form a resulting coat layer, while simultaneously allowing the conductive fine particles, etc. to be contained therein.

(3) Conductive Characteristics

With respect to the conductive characteristics of the resin coat carrier, for example, its volume resistivity (specific resistance) is preferably set to $1\times10^2$ to $1\times10^{14}$ Ω·cm, more preferably, $1\times10^3$ to $1\times10^{10}$ Ω·cm, most preferably, 1×10 to 1×10 Ω·cm.

The reason for this is that the volume resistivity of less than $1\times10^2$ Ω·cm tends to cause a difficulty in suppressing a carrier drawing phenomenon and generation of fog. In contrast, the volume resistivity exceeding $1\times10^{14}$ Ω·cm tends to cause a reduction in the image density, and the subsequent difficulty in suppressing the degradation in the image quality.

(4) Average Particle Size

Moreover, the average particle size of the carrier is preferably set to 20 to 120 μm, more preferably, 20 to 100 μm, most preferably 20 to 80 μm.

The reason for this is that the average particle size of the carrier less than 20 μm tends to cause a carrier developing phemonenon and fog, and in contrast, the average particle size exceeding 120 μm tends to cause degradation in the carrier transporting property.

2. Magnetic Powder Carrier (1) Kinds

With respect to the magnetic powder carrier, for example, magnetic particles, virtually made of magnetic powder such as iron, magnetite or ferrite, may be used.

Here, in order to improve the moisture resistant property, it is preferable to form a resin coat film on the surface of the magnetic powder, with the resin coat film being set to 0.01 to 1% by weight of the entire amount.

(2) Bulk Density

It is preferable to set the bulk density of the magnetic powder carrier to be higher than the bulk density of the resin coat carrier. For example, the bulk density of the resin coat carrier is preferably less than 2.3 g/cm$^3$, while the bulk density of the magnetic powder carrier is preferably not less than 2.3 g/cm$^3$.

With this arrangement, the magnetic powder carrier is allowed to attract the resin coat carrier so that it becomes possible to effectively suppress the generation of carrier drawing that allows the carrier to adhere to the surface of the photosensitive member.

(3) Average Particle Size

Moreover, it is preferable to set the average particle size of the magnetic powder carrier to 20 to 130 μm, more preferably, 20 to 110 μm, most preferably, 20 to 90 μm.

The reason for this is that the average particle size of the magnetic powder carrier of 20 μm tends to cause a carrier drawing phenomenon or fog, and that, in contrast, the average particle size exceeding 130 μm tends to cause degradation in the toner transporting property of the magnetic powder carrier.

(4) Mixing Ratio

The magnetic powder carrier (a) and the resin coat carrier (b) may be respectively used independently; however, it is preferable to use them in combination. In this case, the mixing ratio of the magnetic powder carrier (a) to the resin coat carrier (b) may be set in a wide range; and, for example, when the mixing ratio (weight ratio) is represented by (a)/(b), it is preferable to set the ratio to 85/15 to 45/55.

The reason for this is that the mixing ratio (a)/(b) exceeding 85/15 tends to cause a failure to allow the magnetic powder carrier to sufficiently compensate for the deficiencies of the resin coat carrier, and for example, to result in a reduction in the image density and a difficulty in improving the dot reproducibility.

In contrast, the mixing ratio (a)/(b) smaller than 45/55 tends to cause a failure to allow the resin coat carrier to sufficiently compensate for the deficiencies of the magnetic powder carrier, and for example, to result in fog due to insufficient charging.

Therefore, it is more preferable to set the mixing ratio (a)/(b) to 75/25 to 50/50, most preferably, 70/30 to 40/60.

Here, with respect to the carriers, when the magnetic powder carrier and the resin coat carrier are used in combination with each other, it is possible to form the magnetic brush from the developing roller (magnetic roller) as a brush mainly generated by the magnetic powder carrier having a high magnetic force; therefore, when the carrier is separated from the developing zone, the resin coat carrier is attracted by the carrier having a high magnetic force. As a result, it becomes possible to prevent the generation of carrier drawing that allows the resin coat carrier to be shifted to the photosensitive member together with the toner.

Moreover, by using the resin coat carrier and the magnetic powder carrier in a combined manner, it is possible to reduce (eliminate) an increase in the charge applied to the resin coat carrier; therefore, it becomes possible to stabilize the carrier and the quantity of charge of the toner at the time of developing, and consequently to avoid the occurrence of a situation in which the toner charge coercive force by the carrier comes to exceed the attracting force of the toner due to a potential difference on an electrostatic latent image on the photosensitive member.

3. Addition of Carriers

The mixing ratio of the carriers to the MICR toner may be set widely; and for example, when the mixing ratio (weight ratio) is represented by carrier/MICR toner, it is preferable to set this ratio to 100/1 to 100/10, more preferably, 100/2 to 100/8, most preferably, 100/3 to 100/6.

The reason for this is that the mixing ratio smaller than 100/1 tends to cause degradation in the image density and dot-reproducibility. In contrast, the mixing ratio exceeding 100/10 tends to cause the generation of fog due to insufficient charging.

[Fourth Embodiment]

The fourth Embodiment relates to a manufacturing method of a developer for MICR printers, which comprises steps of forming a toner base particle by mixing a binder resin and magnetic powder, adding metal oxide particles onto the outer surface of the toner base particle, the metal oxide particles having a voltage resistivity of $1\times10^{5}$ to $1\times10^{11}$ Ω·cm, to form a MICR toner, and mixing the MICR toner and the carrier.

Here, in the present embodiment, the processes for forming the toner base particles and the MICR toner are the same as those described in the second Embodiment; therefore, the description thereof is omitted. In the present embodiment, an explanation will be given of the carrier mixing processes.

[Carrier Mixing Process]

The carrier mixing process is a process in which the MICR toner, obtained through the steps of forming the toner base particles and the MICR toner, is mixed with carrier to form a developing for MICR printers; and in this process, the mixing is preferably carried out uniformly by using a mixing and stirring device such as a propeller mixer, a kneader and a V blender.

More specifically, these are preferably mixed and stirred for 3 to 60 minutes by using a propeller mixer so as to set the mixing ratio (weight ratio) of carrier/MICR toner to 100/1 to 100/10.

[Fifth Embodiment]

Next, in the fifth Embodiment, an explanation will be given of an image-forming method in which the MICR toner of the present invention or the developer containing the MICR toner is used.

(1) Photosensitive Member

Figure 2:
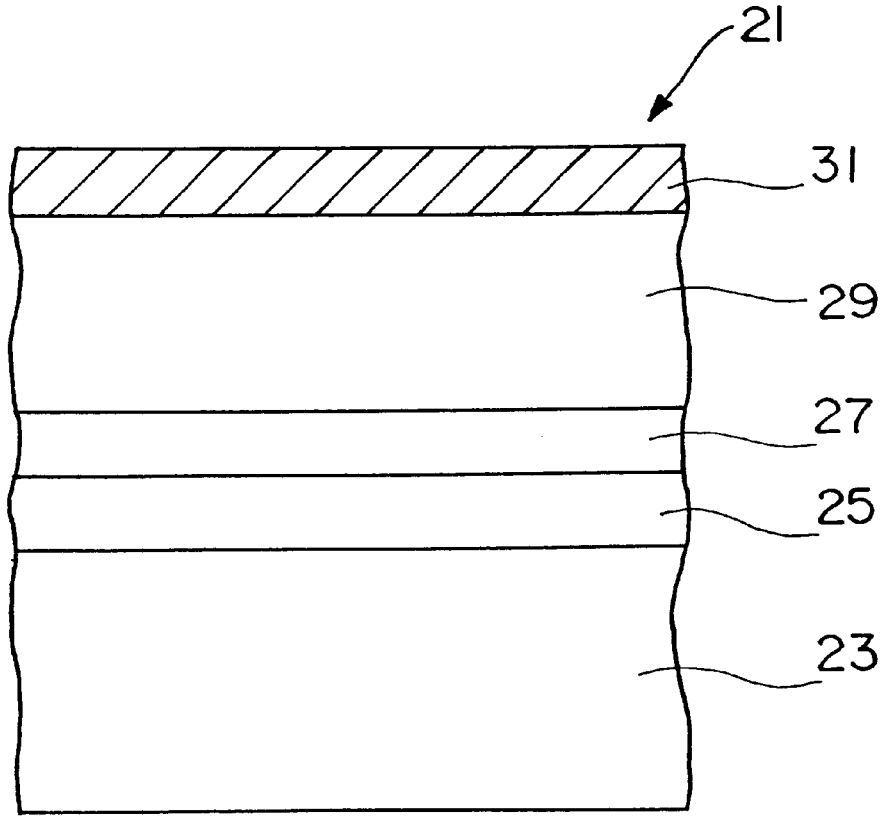
FIG. 2 is a schematic cross-sectional view that shows an essential portion of a photosensitive member.

First, referring to FIG. 2, the following description will discuss the structure of a photosensitive member in an image-forming apparatus to which the present developer is applied.

FIG. 2 is a schematic cross-sectional view showing an essential portion that explains the layer construction of a photosensitive layer of the photosensitive drum. As illustrated in FIG. 2, the photosensitive layer of a photosensitive member 21 has a layer construction in which: on a conductive base 23 are successively formed a light absorbing layer 25 made from elements such as Si/Ge/H, a carrier injection blocking layer 27 made from elements such as Si/H/B/O, a carrier exciting and transporting layer 29 (photo conductive layer) made from elements such as Si/H and a surface protective layer 31.

This surface protective layer 31 is formed by, for example, an SiC layer having a thickness of approximately 0.3 to 1×10 μm, and this construction makes it possible to greatly lengthen the service life of the photosensitive drum.

However, the surface of the surface protective layer 31 made of the SiC layer, generally, is not smooth with a number of fine protrusions (cones) being located thereon, and this SiC layer has a strong hydrophilic property, with the result that hydrophilic compounds such as ammonium nitrate caused by corona discharging tends to exist between the fine protrusions of the SiC layer as ionic products. Therefore, for example, in the case of continuous printing operations or printing operations under highly humid conditions, a great amount of the MICR toner tends to adhere to the surface of the photosensitive drum, toner filming tends to occur thereon, or ionic products tend to occur thereon. For this reason, the charge in the photosensitive member tends to leak, and often results in a so-called "image blurring" phenomenon.

In contrast, the application of the MICR toner or developer of the present invention allows the metal oxide particles 15, fixed onto the surface, to grind the top portions and the proximity thereof of the fine protrusions of the SiC layer to smooth the surface of the SiC layer, and also to remove the ionic products deposited between the fine protrusions effectively. Therefore, even in the case of the application of the photosensitive member having the SiC layer as the surface protective layer 31, it is possible to effectively prevent the occurrence of "image blurring".

Moreover, in the MICR toner of the present invention, the metal oxide particles are properly anchored on the outer surface of each toner particle so that, when pressed, these particles are allowed to properly deform inwards, refraining from applying excessive abrasive force. Therefore, even when a cleaning blade and a sliding roller are used to press the MICR toners to carry out an abrasive process, the surface of the photosensitive member is free from scratches.

(2) Image-forming Method

Figure 3:
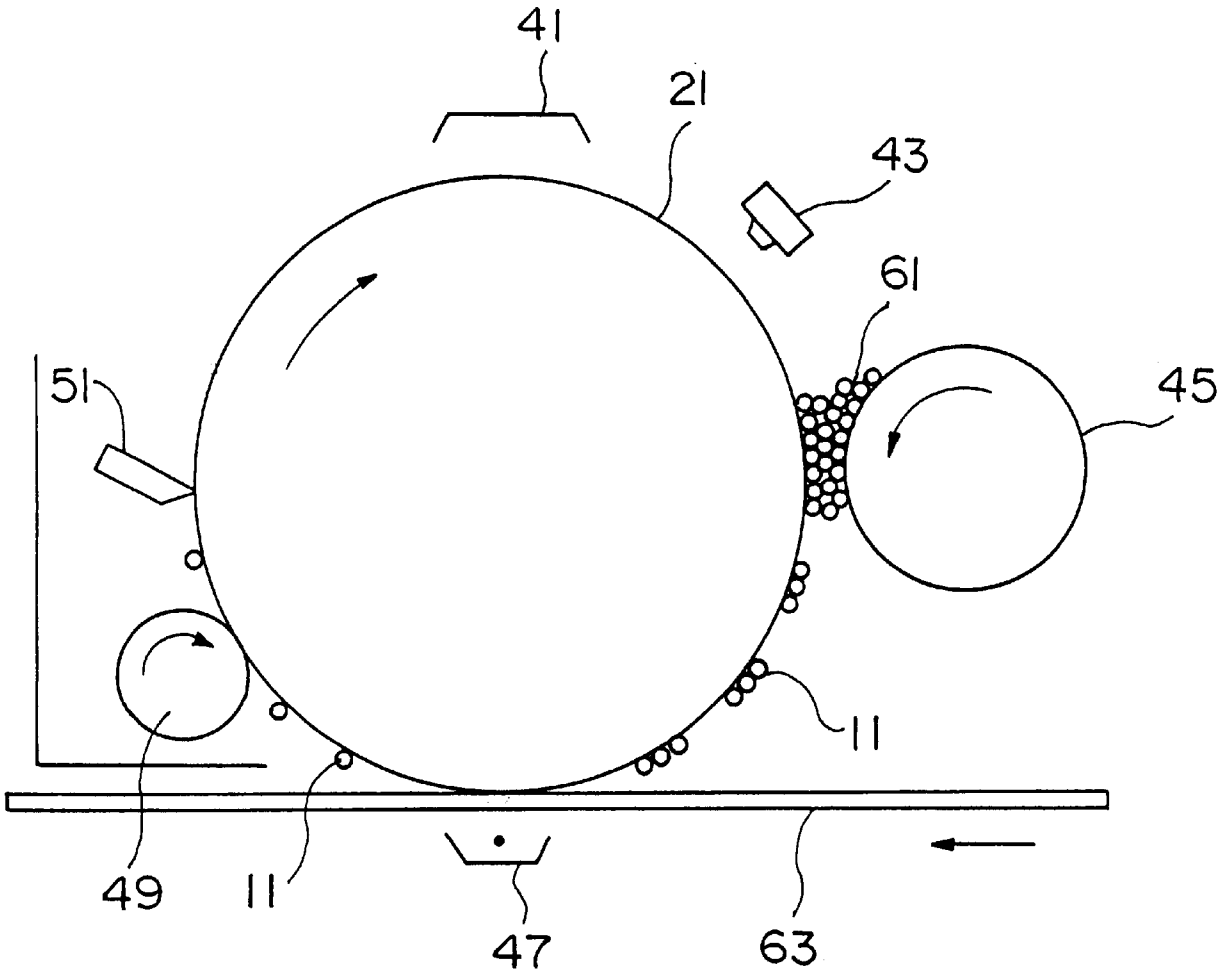
FIG. 3 is a schematic view that explains a structure of an image-forming apparatus.

Next, referring to FIG. 3 which is a schematic drawing that explains the structure of the image-forming apparatus, an explanation will be given of a method for forming images by using the MICR toner or the developer containing the MICR toner, in addition to an explanation for a structural example of the image-forming apparatus.

In this image-forming apparatus, on the periphery of a drum-shapeda-Si photosensitive member 21 are placed a corona charger 41, an LED head 43 (exposing device), a developing roller 45, a transferring device 47, a sliding roller 49 and a cleaning blade 51. Therefore, after the surface of the photosensitive member 21 has been uniformly charged by the corona charger 41 and an electrostatic latent image has been formed by selectively exposing an image through the LED head 43, developer 61 is supplied onto the surface of the photosensitive member 21 by the developing roller 45 so that a visible image made from MICR toner 11 is formed by the developing process.

At this time, the surface of the photosensitive member 21 is properly abraded by the metal oxide particles 15 fixed onto the surface of the MICR toner 11 in the developer 61 so that the SiC layer 31 serving as the surface protective layer is ground. Moreover, since the metal oxide particles 15 are anchored onto the toner base particles 13, they are free from separation, thereby making it possible to avoid problems such as insufficient developing and defective images.

Moreover, the MICR toner 11 on the surface of the photosensitive member 21 is transferred onto paper 63 (recording material) by the transferring device 47, and then fixed onto the paper 63 by a fixing device (not shown).

However, in the transferring process, all the MICR toner 11 on the surface of the photosensitive member 21 is not transferred onto the paper 63, and a part of the MICR toner 11 (residual toner) is left on the photosensitive member 21. Therefore, in the case where the MICR toner of the present invention is used, the toner existing as the residual toner 11 is pressed onto the surface of the photosensitive member 21 by the sliding roller 49 so that the abrasive effects of the metal oxide particles 15 of the MICR toner 11 become greater, making it possible to effectively grind the SiC layer 31.

Next, the residual toner 11 on the photosensitive member 21 is removed from the surface of the photosensitive member 21 by the cleaning blade 51, and at this time also, the residual toner 11 on the photosensitive member 21 is allowed to effectively abrade the SiC layer 31 on the surface of the photosensitive member 21 by the metal oxide particles 15 exposed to the surface of the residual toner 11 through a mechanical force exerted between the cleaning blade 51 and the photosensitive member 21.

Additionally, with respect to the sliding roller 49, an elastic roller is preferably used, and the sliding roller 49 is pressed onto the surface of the photosensitive member 21. In other words, the sliding roller 49 is rotated so that a shearing stress is exerted onto the photosensitive member 21; thus, the SiC layer 31 on the photosensitive member 21 is further effectively abraded, and cleaned.

Moreover, the application of the MICR toner or the developer of the present invention makes it possible to effectively prevent image blurring even when a photosensitive member 21 having the SiC layer 31 is used; and in order to further improve the effects for preventing image blurring, it is preferable to place a heater (not shown) on the inner surface of the photosensitive member 21 so as to apply heat.

EXAMPLES

Example 1

(1) Formation of MICR Toner

① Toner Base Particle Forming Process

In a mixing container were loaded 20 parts by weight of first iron oxide and 20 parts by weight of second iron oxide, which had different values in the residual magnetization as shown in Table 3, as magnetic powder.

TABLE 3

| | First iron oxide | Second iron oxide |
|---|---|---|
| Shape | Needle shape | Granular shape |
| Residual magnetization (emu/g) | 30.5 | 18.1 |
| Saturated magnetization (emu/g) | 84.0 | 87.0 |
| Average particle size ($\mu$m) | 0.7 | 0.4 |
| Aspect ratio (major axis/minor axis) | 3.57 | 1.33 |
| BET surface area ($m^2/g$) | 15.5 | 3.8 |
| Bulk density ($g/cm^3$) | 1.1 | 1.4 |
| Coercive force (Oe) | 335.0 | 221.0 |

Next, 100 parts by weight of styrene-acrylic copolymer (softening point: 123° C., Tg: 65° C.) and 2.5 parts by weight of Fischer Tropsch wax (sazol wax C2, weight average molecular weight: 1, 262) were loaded into the mixing container, and this was uniformly mixed and dispersed to form a mixture with the magnetic powder.

Here, to the first and second magnetic powders of respectively 100 parts by weight were respectively added 1 part by weight of γ-aminopropyltriethoxylsilane, and these magnetic powders were preliminarily subjected to a surface treatment. Moreover, with respect to dry-type silica fine powder subjected to a hydrophobic-property applying process, an amino-group was introduced to dry-type silica fine powder by using γ-aminopropyltriethoxylsilane, and this was further subjected to the hydrophobic-property applying process by using silicone oil.

Next, the resulting mixture was ground by using a grinder into coarse particles, and then classified to obtain toner base particles having an average particle size of 7 $\mu$m.

Here, the grain distribution of the toner base particles was measured by using a grain distribution meter so that it was confirmed that 80% by weight of the weight of the particles was located within the range of 5 to 10 $\mu$m.

② Metal Oxide Particle Adding Process

Next, to 100 parts by weight of the resulting toner base particles were added 1.4 parts by weight of titanium oxide (average particle size: 0.4 $\mu$m) serving as the metal oxide subjected to a conductivity-applying process, and 1.0 part by weight of the dry-type silica fine powder (average particle size: 0.01 $\mu$m) subjected to the hydrophobic-property applying process so that the titanium oxide and the dry-type silica fine powder were uniformly charged and allowed to adhere to the periphery of each of the toner base particles, and this was then mixed in a Henschel Mixer FM20C/I (made by Mitsui Mining Co., Ltd.) under conditions of 1,600 rpm for 4 min. so that the metal oxide particles were fixed onto the outer surface of the toner base particles with a part thereof being exposed, thereby providing a MICR toner.

(2) Evaluation of MICR Toner

Evaluations were made on the resulting MICR toner on the following characteristics. Moreover, the MICR toner was loaded into a printer made by KYOCERA CORPORATION (Ecosys, FS-3700), and font (E-13B type) was continuously printed on A-4 paper corresponding to check paper; thus, evaluations were made on the image density, etc.

(2-1) Measurements on Residual Magnetization, Saturated Magnetization and Coercive Force The residual magnetization, saturated magnetization and coercive force of the resulting MICR toner were respectively measured by using a magnetic force measuring device VSM (made by TOEI INDUSTRY CO., LTD), and the results are listed on Table 4.

(2-2) Evaluation on Dispersing Property

By using a Microtome MT6000-XL (made by RMC Ltd.), the MICR toner was cut. Then, the toner cross-section was observed under an electron microscope, and evaluations were made on the dispersing property in the magnetic powder of the MICR toner based upon the following criteria. The results are listed on Table 4.

Here, evaluation X indicates that the dispersing property of the magnetic powder is so poor that it cannot be used as the MICR toner; evaluation Δ indicates that the dispersing property is located within a permissible range, and evaluation ○ indicates that it is desirably used as the MICR toner.

○: No lumps of magnetic powder (having a diameter of not less than 1 mm in a photograph of ×100) was observed.

Δ: One lump of magnetic powder (having a diameter of not less than 1 mm in a photograph of ×100) was observed.

X: Two or more lump s of magnetic powder (having a diameter of not less than 1 mm in a photograph of ×100) were observed.

(2-3) Evaluation on Image Density

The resulting MICR toner was loaded into a printer made by KYOCERA CORPORATION (Ecosys, FS-3750), and a solid black pattern was printed; thus, the image density was measured by using a Macbeth reflection-type densitometer RD914 (made by Macbeth Process Measurements Co.). The results are listed on Table 4.

(2-4) Evaluation on Durability

The resulting MICR toner was loaded into a printer made by KYOCERA CORPORATION (Ecosys, FS-3750), and image-evaluating patterns, which correspond to MICR fonts E-13B and CMC-7, were continuously printed on sheets of A-4 paper; thus, evaluations were made on the durability of the MICR toner. The results are listed on Table 4.

(2-5) Evaluation on Readability

Figure 5:
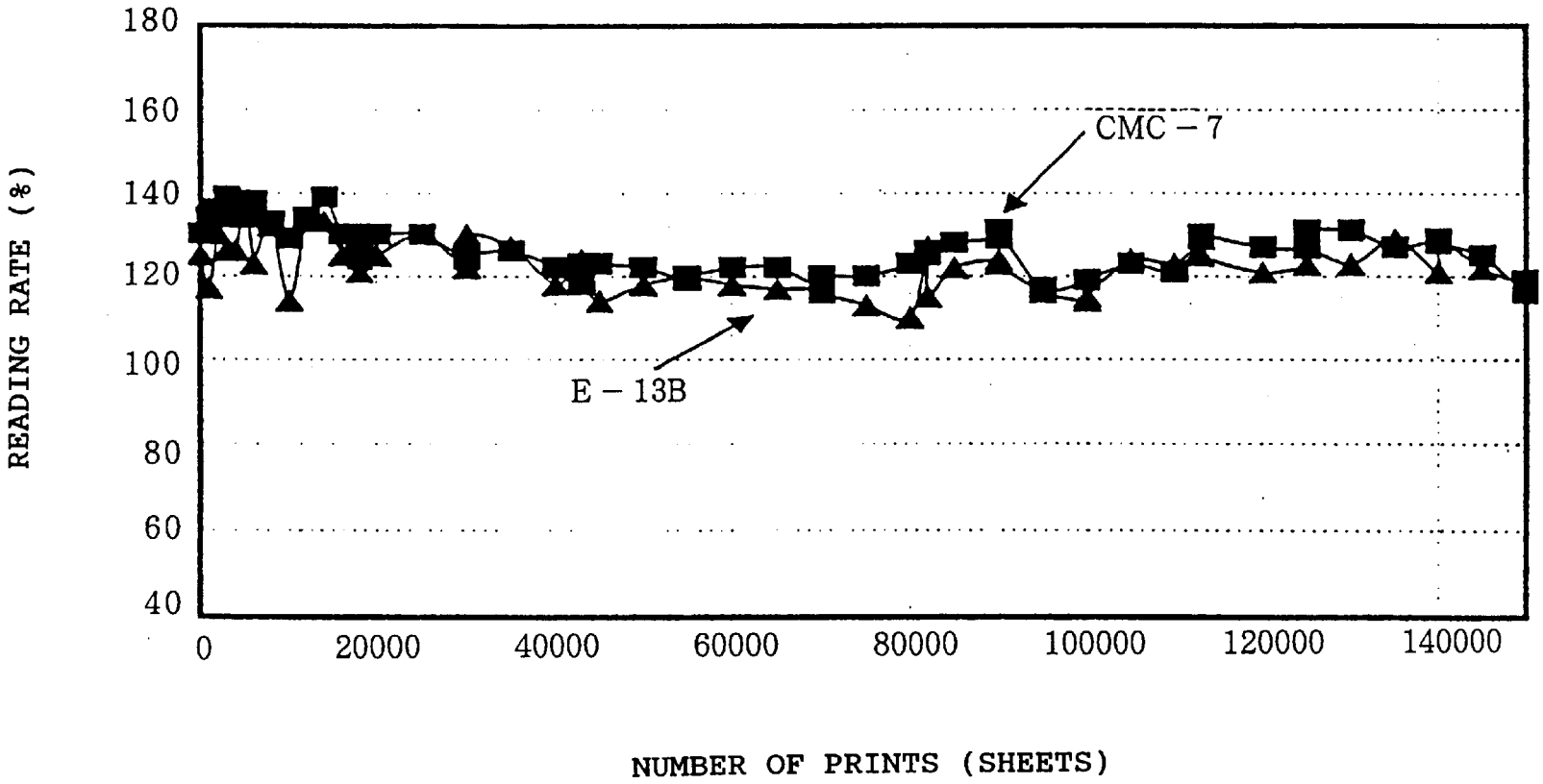
FIG. 5 is a drawing that shows the relationship between the number of printed sheets of A-4 paper and the reading rate of Example 1.
Figure 6:
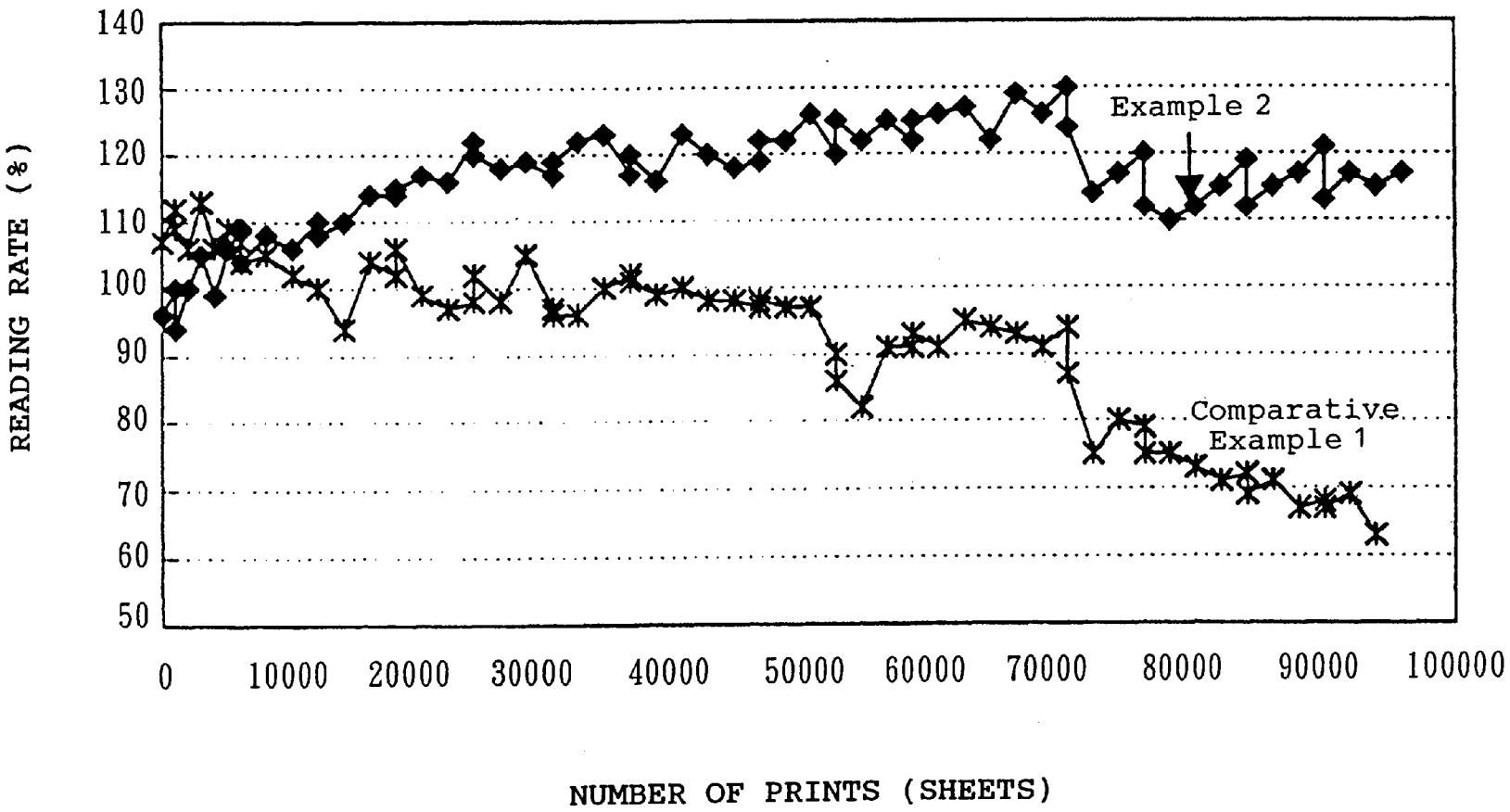
FIG. 6 is a drawing that shows the relationship between the number of printed sheets of A-4 paper and the reading rate in Example 2 and Comparative Example 1.

The resulting MICR toner was loaded into a printer made by KYOCERA CORPORATION (Ecosys, FS-3750), and image-evaluating patterns, which correspond to MICR fonts E-13B and CMC-7, were continuously printed on 300,000 sheets of A-4 paper; thus, evaluations were made on the reading rate by using a MICR qualifier (RDM Co.). The results are listed on Table 4 and FIG. 5 (up to 100,000 continuous prints).

Here, when reading rates (%) of E-13B and CMC-7 were respectively located in the range of 80 to 200%, it was confirmed that the fonts were appropriately read.

Examples 2 to 4 and Comparative Examples 1 to 3

The same processes as Example 1 were carried out except that the volume resistivity of the metal oxide particles was changed as shown in Table 4 so that MICR toners were respectively manufactured, and evaluated. The results are listed on Table 4 as well as FIGS. 4 and 5.

Examples 5 to 8 and Comparative Examples 4 to 6

The same processes as Examples 1 to 4 as well as Comparative Examples 1 to 3 were carried out except that the kinds of the metal oxide particles in Examples 1 and 2 were changed from the dry-type silica fine particles to alumina (average particle size: 0.4 μm) so that MICR toners were respectively manufactured, and evaluated. The results are listed on Table 5.

TABLE 4

| | | Comparative Example 1 | Example 1 | Example 2 | Example 3 | Example 4 | Comparative Example 2 | Comparative Example 3 |
|---|---|---|---|---|---|---|---|---|
| Toner | Kinds of magnetic powder | Needle-shape/ Granular-shape 20/20 | Needle-shape/ Granular-shape 20/20 | Needle-shape/ Granular-shape 20/20 | Needle-shape/Granular-shape 20/20 | Needle-shape/Granular-shape 20/20 | Needle-shape/Granular-shape 20/20 | Needle-shape/Granular-shape 20/20 |
| | Amount of magnetic powder | | | | | | | |
| | Residual magnetization emu/g | 8.72 | 8.72 | 8.72 | 8.72 | 8.72 | 8.72 | 8.72 |
| | Saturated magnetization emu/g | 32.2 | 32.2 | 32.2 | 32.2 | 32.2 | 32.2 | 32.2 |
| | Coercive force kA/m | 23.9 | 23.9 | 23.9 | 23.9 | 23.9 | 23.9 | 23.9 |
| | Dispersing property | ○ | ○ | ○ | ○ | ○ | ○ | ○ |
| | Metal oxide Resistivity Ω · cm | $1 \times 10^3$ | $5 \times 10^5$ | $1 \times 10^6$ | $1 \times 10^7$ | $1 \times 10^9$ | $1 \times 10^{13}$ | $1 \times 10^{15}$ |
| Evaluation | Initial image density | 1.35 | 1.35 | 1.35 | 1.35 | 1.35 | 1.35 | 1.35 |
| | Image density (300,000 prints) | 1.28 | 1.32 | 1.28 | 1.32 | 1.10 | 1.10 | 1.10 |
| | E-13B Initial reading rate (%) | 110 | 110 | 120 | 120 | 110 | 110 | 110 |
| | E-13B reading rate (%) (300,000 prints) | less than 60 | 90 | 120 | 120 | 110 | less than 60 | less than 60 |
| | CMC-7 Initial reading rate (%) | 110 | 110 | 120 | 120 | 110 | 110 | 110 |
| | CMC-7 reading rate (%) (300,000 prints) | less than 60 | 90 | 120 | 120 | 110 | less than 60 | less than 60 |

TABLE 5

| | | Comparative Example 4 | Example 5 | Example 6 | Example 7 | Example 8 | Comparative Example 5 | Comparative Example 6 |
|---|---|---|---|---|---|---|---|---|
| Toner | Kinds of magnetic powder | Needle-shape/ Granular-shape 20/20 | Needle-shape/ Granular-shape 20/20 | Needle-shape/ Granular-shape 20/20 | Needle-shape/Granular-shape 20/20 | Needle-shape/Granular-shape 20/20 | Needle-shape/Granular-shape 20/20 | Needle-shape/Granular-shape 20/20 |
| | Amount of magnetic powder | | | | | | | |
| | Residual magnetization emu/g | 8.72 | 8.72 | 8.72 | 8.72 | 8.72 | 8.72 | 8.72 |
| | Saturated magnetization emu/g | 32.2 | 32.2 | 32.2 | 32.2 | 32.2 | 32.2 | 32.2 |
| | Coercive force kA/m | 23.9 | 23.9 | 23.9 | 23.9 | 23.9 | 23.9 | 23.9 |
| | Dispersing property | ○ | ○ | ○ | ○ | ○ | ○ | ○ |
| | Metal oxide Resistivity Ω · cm | $1 \times 10^3$ | $5 \times 10^5$ | $1 \times 10^6$ | $1 \times 10^7$ | $1 \times 10^9$ | $1 \times 10^{13}$ | $1 \times 10^{15}$ |
| Evaluation | Initial image density | 1.35 | 1.35 | 1.35 | 1.35 | 1.35 | 1.35 | 1.35 |
| | Image density (300,000 prints) | 1.28 | 1.32 | 1.28 | 1.32 | 1.10 | 1.10 | 1.10 |
| | E-13B Initial Reading rate (%) | 110 | 110 | 120 | 120 | 110 | 110 | 110 |
| | E-13B reading rate (%) (300,000 prints) | Less than 60 | 90 | 120 | 120 | 110 | less than 60 | less than 60 |
| | CMC-7 Initial reading rate (%) | 110 | 110 | 120 | 120 | 110 | 110 | 110 |
| | CMC-7 reading rate (%) (300,000 prints) | Less than 60 | 90 | 120 | 120 | 110 | less than 60 | less than 60 |

Example 9

(1) Formation of Developer for MICR Printers

① Toner Base Particle Formation Process and Metal Oxide Particle Adding Process

MICR toners were obtained by carrying out the same processes as Example 1.

② Carrier Mixing Process

Next, the resulting MICR toner was loaded into a propeller mixing and stirring machine in a manner so as to set its addition to 5 parts by weight per 100 parts by weight of the carrier (weight ratio of magnetic powder carrier/resin coat carrier=85/15). This was stirred under conditions of 100 rpm for 30 minutes to prepare a developer for MICR printers.

(2) Evaluation of Developer for MICR Printers

Evaluations were made on the resulting developer for MICR printers on the following properties. Moreover, the developer for MICR printers was loaded into a printer made by KYOCERA CORPORATION (Ecosys, FS-3700), and font (E-13B type) was continuously printed on A-4 paper corresponding to check paper; thus, evaluations were made on the image density, etc.

(2-1) Measurements on Residual Magnetization and Saturated Magnetization

The residual magnetization and saturated magnetization of the resulting developer for MICR printers were respectively measured in the same manner as Example 1, and the results are listed on Table 6.

(2-2) Evaluation on Dispersing Property

The MICR toner particle contained in the developer for MICR printers was cut in the same manner as Example 1, and evaluations were made on the dispersing property in the MICR toner. The results are listed on Table 6.

(2-3) Evaluation on Image Density

The resulting developer for MICR printers was loaded into a printer made by KYOCERA CORPORATION (Ecosys, FS-3750), and a solid black pattern was printed; thus, the image density was measured by using a Macbeth reflection-type densitometer RD914 (made by Macbeth Process Measurements Co.). The results are listed on Table 6.

(2-4) Evaluation on Durability

The resulting developer for MICR printers was loaded into a printer made by KYOCERA CORPORATION (Ecosys, FS-3750), and image-evaluating patterns, which correspond to MICR fonts E-13B and CMC-7, were continuously printed on sheets of A-4 paper; thus, evaluations were made on the durability of the developer for MICR printers. The results are listed on Table 6.

(2-5) Evaluation on Readability

The resulting developer for MICR printers was loaded into a printer made by KYOCERA CORPORATION (Ecosys, FS-3750), and image-evaluating patterns, which correspond to MICR fonts E-13B and CMC-7, were continuously printed on 150,000 sheets of A-4 paper; thus, evaluations were made on the reading rate by using a MICR qualifier (made by RDM Co.). The results are listed on Table 6.

Here, when reading rates (%) of E-13B and CMC-7 were respectively located in the range of 80 to 200%, it was confirmed that the fonts were appropriately read.

Examples 10 to 12 and Comparative Examples 7 to 9

The same processes as Example 9 were carried out except that the volume resistivity of the metal oxide particles was changed as shown in Table 4 so that MICR toners were respectively manufactured, and evaluated. The results are listed on Table 6.

Examples 13 to 16 and Comparative Examples 10 to 12

The same processes as Examples 9 to 12 as well as Comparative Examples 7 to 9 were carried out except that the kinds of the metal oxide particles in Examples 9 and 10 were changed from the dry-type silica fine particles to alumina (average particle size: 0.4 $\mu$m) so that developer for MICR printers were respectively manufactured, and evaluated. The results are listed on Table 7.

TABLE 6

| | | Comparative Example 7 | Example 9 | Example 10 | Example 11 | Example 12 | Comparative Example 8 | Comparative Example 9 |
|---|---|---|---|---|---|---|---|---|
| Toner | Kinds of magnetic powder | Needle-shape/ | Needle-shape/ | Needle-shape/ | Needle-shape/ | Needle-shape/Granular- | Needle-shape/Granular- | Needle-shape/Granular- |
| | Amount of magnetic powder | Granular-shape 20/20 | Granular-shape 20/20 | Granular-shape 20/20 | Granular-shape 20/20 | shape 20/20 | shape 20/20 | shape 20/20 |
| | Residual magnetization emu/g | 8.72 | 8.72 | 8.72 | 8.72 | 8.72 | 8.72 | 8.72 |
| | Saturated magnetization emu/g | 32.2 | 32.2 | 32.2 | 32.2 | 32.2 | 32.2 | 32.2 |
| | Dispersing property | ○ | ○ | ○ | ○ | ○ | ○ | ○ |
| | Metal oxide Resistivity Ω · cm | $1 \times 10^3$ | $5 \times 10^5$ | $1 \times 10^6$ | $1 \times 10^7$ | $1 \times 10^9$ | $1 \times 10^{13}$ | $1 \times 10^{15}$ |
| Carrier | Magnetic powder Carrier addition (parts by weight) | 85 | 85 | 85 | 85 | 85 | 85 | 85 |
| | Resin coat Carrier addition (parts by weight) | 15 | 15 | 15 | 15 | 15 | 15 | 15 |
| Evaluation | Initial image density | 1.35 | 1.35 | 1.35 | 1.35 | 1.35 | 1.35 | 1.35 |
| | Image density (150,000 prints) | 1.28 | 1.32 | 1.28 | 1.32 | 1.10 | 1.10 | 1.10 |
| | E-13 Initial reading rate (%) | 110 | 110 | 120 | 120 | 110 | 110 | 110 |
| | E-13B reading rate (%) (150,000 prints) | Less than 60 | 90 | 120 | 120 | 110 | less than 60 | less than 60 |
| | CMC Initial reading rate (%) | 110 | 110 | 120 | 120 | 110 | 110 | 110 |
| | CMC-7 reading rate (%) (150,000 prints) | Less than 60 | 90 | 120 | 120 | 110 | less than 60 | less than 60 |

TABLE 7

| | | Comparative Example 10 | Example 13 | Example 14 | Example 15 | Example 16 | Comparative Example 11 | Comparative Example 12 |
|---|---|---|---|---|---|---|---|---|
| Toner | Kinds of magnetic powder | Needle-shape/ | Needle-shape/ | Needle-shape/ | Needle-shape/ | Needle-shape/Granular- | Needle-shape/Granular- | Needle-shape/Granular- |
| | Amount of magnetic powder | Granular-shape 20/20 | Granular-shape 20/20 | Granular-shape 20/20 | Granular-shape 20/20 | shape 20/20 | shape 20/20 | shape 20/20 |
| | Residual magnetization emu/g | 8.72 | 8.72 | 8.72 | 8.72 | 8.72 | 8.72 | 8.72 |
| | Saturated magnetization emu/g | 32.2 | 32.2 | 32.2 | 32.2 | 32.2 | 32.2 | 32.2 |
| | Dispersing property | ○ | ○ | ○ | ○ | ○ | ○ | ○ |
| | Metal oxide Resistivity Ω · cm | $1 \times 10^3$ | $5 \times 10^5$ | $1 \times 10^6$ | $1 \times 10^7$ | $1 \times 10^9$ | $1 \times 10^{13}$ | $1 \times 10^{15}$ |
| Carrier | Magnetic Powder Carrier addition (parts by weight) | 85 | 85 | 85 | 85 | 85 | 85 | 85 |
| | Resin coat Carrier addition (parts by weight) | 15 | 15 | 15 | 15 | 15 | 15 | 15 |
| Evaluation | Initial image density | 1.35 | 1.35 | 1.35 | 1.35 | 1.35 | 1.35 | 1.35 |
| | Image density (150,000 prints) | 1.28 | 1.32 | 1.28 | 1.32 | 1.10 | 1.10 | 1.10 |
| | E-13B Initial reading rate (%) | 110 | 110 | 120 | 120 | 110 | 110 | 110 |
| | E-13B reading rate (%) (150,000 prints) | Less than 60 | 90 | 120 | 120 | 110 | less than 60 | less than 60 |
| | CMC-7 Initial reading rate (%) | 110 | 110 | 120 | 120 | 110 | 110 | 110 |
| | CMC-7 reading rate (%) (150,000 prints) | Less than 60 | 90 | 120 | 120 | 110 | less than 60 | less than 60 |

The invention is based on Japanese Patent Applications Serial No. 2000-127142 and No. 2000-234641, which are hereby incorporated by reference.

It is to be understood by those skilled in the art that the forgoing description relates to preferred embodiments of the invention and that various changes and modifications may be made in the invention without departing from the spirit and scope thereof. Also it is to be understood that the invention is not limited to the embodiments thereof except as defined in the appended claims.

What is claimed is:

1. A magnetic toner for MICR printers, comprising;

a binder resin;

magnetic power;

metal oxide particles, a part of which are fixed and exposed in an outer surface of a toner base particle made from the binder resin and the magnetic powder, the metal oxide particles having a volume resistivity $1\times10^5$ to $1\times10^{11}$ Ω·cm; and a silica fine powder as an externally additive agent;

the magnetic toner being obtained by mixing the toner base particle, the silica fine powder and the metal oxide particles at 1200 to 2000 rpm for 2 to 6 minutes or at 1400 to 1800 rpm for 1 to 6 minutes in a Henschel Mixer.

2. The magnetic toner of claim 1, wherein the toner has a reading rate of in the range of 80% to 200% after 150,000 sheets of A-4 paper are continuously printed.

3. The magnetic toner of claim 1, wherein the metal oxide particles have an average particle size of 50 nm to 1 μm.

4. The magnetic toner of claim 1, wherein the metal oxide particles have a hardness of 5 to 7.5 in Moh's hardness.

5. The magnetic toner of claim 1, wherein an addition amount of the metal oxide particles is 0.1 to 2% by weight of a total amount.

6. The magnetic toner of claim 1, wherein the metal oxide particles are made of aluminum oxide, titanium oxide or combination thereof.

7. The magnetic toner of claim 1, wherein the magnetic powder is a mixture of first magnetic powder having a residual magnetization of 24 to 40 emu/g and second magnetic powder having a residual magnetization of 1 to 24 exclusive emu/g.

8. A manufacturing method of a magnetic toner for MICR printers, comprising the steps of:

forming a toner base particle by mixing a binder resin and magnetic power; and mixing a silica fine powder as an externally additive agent, metal oxide particles having a volume resistivity of $1\times10^5$ to $10^{11}$ Ω·cm and the toner base particle at 1200 to 2000 rpm for 2 to 6 minutes or at 1400 to 1800 rpm for 1 to 6 minutes in a Henschel Mixer to fix and expose a part of the metal oxide particles in an outer surface of the toner base particle.

9. A developer used for MICR printers comprising;

the MICR toner of claim 1; and a carrier.

10. The manufacturing method of claim 8, wherein, in the mixing step, the silica fine powder and the metal oxide particles are adhered to a periphery of the toner base particle, and then mixed at 1200 to 2000 rpm for 2 to 6 minutes or at 1400 to 1800 rpm for 1 to 6 minutes in a Henschel Mixer.

11. A manufacturing method of a developer for MICR printers, comprising the steps of:

forming a toner base particle by mixing a binder resin and magnetic power;

mixing a silica fine powder as an externally additive agent, metal oxide particles having a volume resistivity of of $1\times10^5$ to $10^{11}$ Ω·cm and the toner base particle at 1200 to 2000 rpm for 2 to 6 minutes or at 1400 to 1800 rpm for 1 to 6 minutes in a Hensehel Mixer to fix and expose a part of the metal oxide particles in an outer surface of the toner base particle to form a MICR toner; and mixing the MICR toner and a carrier.

* * * * *